US011300088B2

(12) United States Patent
Watanabe et al.

(10) Patent No.: US 11,300,088 B2
(45) Date of Patent: Apr. 12, 2022

(54) FUEL INJECTION VALVE

(71) Applicant: DENSO CORPORATION, Kariya (JP)

(72) Inventors: Yuki Watanabe, Kariya (JP); Kouichi Mochizuki, Kariya (JP); Atsuya Okamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/331,444

(22) Filed: May 26, 2021

(65) Prior Publication Data

US 2021/0285412 A1 Sep. 16, 2021

Related U.S. Application Data

(63) Continuation of application No. PCT/JP2019/038673, filed on Oct. 1, 2019.

(30) Foreign Application Priority Data

Nov. 28, 2018 (JP) ..... JP2018-222657

(51) Int. Cl.
*F02M 61/18* (2006.01)
*F02M 51/00* (2006.01)
*F02M 61/10* (2006.01)

(52) U.S. Cl.
CPC .... *F02M 61/1886* (2013.01); *F02M 61/1806* (2013.01); *F02M 61/10* (2013.01)

(58) Field of Classification Search
CPC ..... F02M 61/10; F02M 61/16; F02M 61/18; F02M 61/1806; F02M 61/1886; F02M 47/00; F02M 47/02; F02F 51/00; F02F 51/06
See application file for complete search history.

(56) References Cited

U.S. PATENT DOCUMENTS 6,695,230 B1 2/2004 Boecking
2002/0088880 A1* 7/2002 Okamoto ..... F02M 61/18 239/585.1
2007/0040053 A1 2/2007 Date
2007/0057093 A1* 3/2007 Gunji ..... B21J 9/04 239/533.12

(Continued)

FOREIGN PATENT DOCUMENTS

JP 2003-120474 4/2003
JP 2007-231771 9/2007

(Continued)

*Primary Examiner* — John Kwon
*Assistant Examiner* — Johnny H Hoang
(74) *Attorney, Agent, or Firm* — Nixon & Vanderhye P.C.

(57) ABSTRACT

A valve body has a seat surface swollen toward a seating surface of an injection hole body having an injection hole. A fuel passage is between the injection hole body and the valve body and is opened and closed due to separation and seating of the seat surface. In a seat portion throttle state, a flow rate of injected fuel is throttled by a gap between the seat surface and the seating surface. In an injection hole throttle state, the flow rate of fuel is throttled by the injection hole. When the valve body is operated from a valve closing position to a full lift position, the seat portion throttle state is brought from the valve closing position to a predetermined intermediate position, and the injection hole throttle state is brought from the intermediate position to the full lift position.

6 Claims, 23 Drawing Sheets

(56) References Cited

U.S. PATENT DOCUMENTS

| | | | | |
|---|---|---|---|---|
| 2012/0006300 | A1 | 1/2012 | Akabane | |
| 2012/0325938 | A1* | 12/2012 | Sakata | F02M 61/1846 239/585.1 |
| 2018/0180009 | A1 | 6/2018 | Sano et al. | |

FOREIGN PATENT DOCUMENTS

| | | |
|---|---|---|
| JP | 2010-038126 | 2/2010 |
| JP | 2011-027081 | 2/2011 |
| JP | 2016-098702 | 5/2016 |
| JP | 2017-036678 | 2/2017 |
| JP | 2017-210890 | 11/2017 |
| JP | 2019-157678 | 9/2019 |

* cited by examiner

FUEL INJECTION VALVE

CROSS REFERENCE TO RELATED APPLICATION

The present application is a continuation application of International Patent Application No. PCT/JP2019/038673 filed on Oct. 1, 2019, which designated the U.S. and claims the benefit of priority from Japanese Patent Application No. 2018-222657 filed on Nov. 28, 2018. The entire disclosures of all of the above applications are incorporated herein by reference.

TECHNICAL FIELD

The present disclosure relates to a fuel injection valve.

BACKGROUND

Conventionally, a fuel injection valve is provided to an internal combustion engine to inject fuel from an injection hole.

SUMMARY

According to an aspect of the present disclosure, a fuel injection valve comprises: an injection hole body having an injection hole configured to inject fuel; a valve body having a seat surface configured to be separated from and seated on a seating surface of the injection hole body; and a fuel passage between the injection hole body and the valve body, the fuel passage configured to communicate with an inflow port of the injection hole and configured to be opened and closed due to separation and seating of the valve body.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
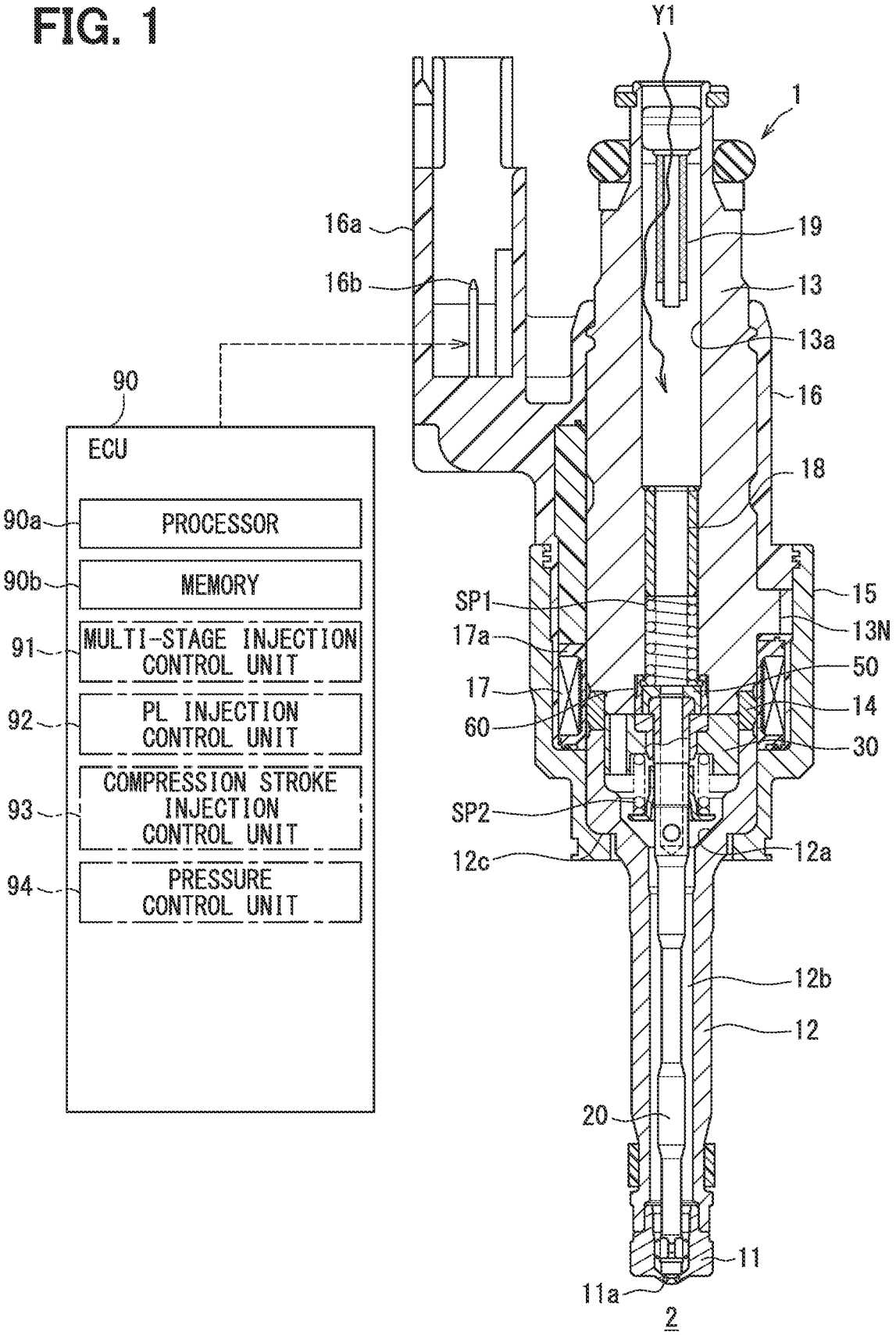
FIG. 1 is a sectional view of a fuel injection valve according to a first embodiment.

As follow, examples of the present disclosure will be described.

According to an example of the present disclosure, a fuel injection valve is configured to inject fuel from an injection hole. The fuel injection valve includes an injection hole body that is provided with an injection hole, a valve body that opens and closes the injection hole, and an electric actuator that operates the valve body to be opened.

According to an example of the present disclosure, an injection amount of a fuel injected from the injection hole in valve opening performed once is controlled by an energization time of the electric actuator. Thus, it may be conceivable to reduce an instrumental error variation in the injection amount with respect to the energization time such that the injection amount can be controlled with high accuracy.

According to an example of the present disclosure, a fuel injection valve includes: an injection hole body having an injection hole configured to inject fuel; a valve body having a seat surface configured to be separated from and seated on a seating surface of the injection hole body; and a fuel passage between the injection hole body and the valve body, the fuel passage configured to communicate with an inflow port of the injection hole and configured to be opened and closed due to separation and seating of the valve body. The seat surface is curved and is swollen toward the seating surface. In a seat portion throttle state, a flow rate of the fuel injected from the injection hole is restricted to a flow rate throttled by a gap between the seat surface and the seating surface. In an injection hole throttle state, the flow rate of the fuel is restricted to a flow rate throttled by the injection hole. When the valve body is operated to be opened from a valve closing position to a full lift position, the seat portion throttle state is brought from the valve closing position to a predetermined intermediate position, and the injection hole throttle state is brought from the intermediate position to the full lift position.

According to an example of the present disclosure, a fuel injection valve includes: an injection hole body having an injection hole configured to inject fuel for combustion of an internal combustion engine; a valve body having a seat surface configured to be separated from and seated on a seating surface of the injection hole body; and a fuel passage between the injection hole body and the valve body, the fuel passage configured to communicate with an inflow port of the injection hole and configured to be opened and closed due to separation and seating of the valve body. The seat surface is curved and is swollen toward the seating surface. In a seat portion throttle state, a flow rate of the fuel injected from the injection hole is restricted to a flow rate throttled by a gap between the seat surface and the seating surface. In an inter-seat-injection-hole throttle state, the fuel is restricted to a flow rate throttled by an inter-seat-injection-hole gap that is a portion of the fuel passage on a downstream side of the seating surface. When the valve body is operated to be opened from a valve closing position to a full lift position, the seat portion throttle state is brought from the valve closing position to a predetermined intermediate position, and the inter-seat-injection-hole throttle state is brought from the intermediate position to the full lift position.

In a view point, even when the valve body is seated (closed) on the seating surface, the fuel remaining in the portion (seat downstream passage) of the fuel passage on the downstream side of the seating surface leaks from the injection hole immediately after the valve is closed. The fuel that has leaked as described above may adhere to the outer surface of the injection hole body or the inner surface of the injection hole, deteriorate in quality, and accumulate as a deposit. When the deposit is accumulated around the outflow port of the injection hole, a spray shape or an injection amount of the fuel injected from the injection hole becomes different from the intention. In consideration of this point, the seat surface in the first and second aspects are curved and is swollen toward the seating surface. Consequently, a volume of the seat downstream passage is reduced, and thus the leakage amount can be reduced.

However, when the volume of the seat downstream passage is reduced as described above, there is new concern as follows. That is, when the valve body is operated to be opened from the valve closing position to the full lift position, the throttle portion that restricts a flow rate of the fuel injected from the injection hole may change in the following three stages according to a lift position of the valve body (refer to FIG. 11).

First, in the first stage, in a lift region from the valve closing position to the predetermined first intermediate position, the "seat portion throttle state" in which the flow rate of the fuel is restricted to a flow rate throttled by the gap between the seat surface and the seating surface is brought. In the next second stage, in a lift region from the first intermediate position to the predetermined second intermediate position, the "inter-seat-injection-hole throttle state" in which the flow rate of the fuel is restricted to a flow rate throttled by a passage sectional area of the seat downstream passage that is the portion of the fuel passage on the downstream side of the seating surface is brought. In the next third stage, in a lift region from the second intermediate position to the full lift position, the "injection hole throttle state" in which the flow rate of the fuel is restricted to a flow rate throttled by a passage sectional area of the injection hole is brought.

In a case of a structure in which the throttle portion changes in three stages as described above, an instrumental error variation in each portion is reflected in an instrumental error variation in an injection amount with respect to the energization time, and thus the instrumental error variation in the injection amount increases.

In consideration of this point, the fuel injection valve according to the first aspect is configured to be brought into in the "seat portion throttle state" from the valve closing position to the intermediate position, and is brought into the "injection hole throttle state" from the intermediate position to the full lift position. That is, the throttle portion changes in two stages of the "seat portion throttle state" and the "injection hole throttle state". The fuel injection valve according to the second aspect is configured to be brought into the "seat portion throttle state" from the valve closing position to the intermediate position, and brought into the "inter-seat-injection-hole throttle state" from the intermediate position to the full lift position. That is, the throttle portion changes in two stages of the "seat portion throttle state" and the "inter-seat-injection-hole throttle state".

As described above, according to the first aspect and the second aspect, since the throttle portion changes in two stages, an instrumental error variation in an injection amount with respect to the energization time is reduced compared with a case where the throttle portion changes in three stages as described above.

Hereinafter, multiple embodiments of the present disclosure will be described with reference to the drawings. Repeated description may be omitted by giving the same reference numerals to the corresponding constituents in each embodiment. When only a part of a configuration is described in each embodiment, configurations of other embodiments described above may be applied to remaining parts of the configuration.

First Embodiment

A fuel injection valve 1 illustrated in FIG. 1 is attached to a cylinder head of an ignition type internal combustion engine mounted in a vehicle, and is of a direct injection type of injecting a fuel directly into a combustion chamber 2 of the internal combustion engine. A liquid gasoline fuel stored in an in-vehicle fuel tank is pressurized by a fuel pump (not illustrated) and supplied to the fuel injection valve 1, and the supplied high-pressure fuel is injected from an injection hole 11*a* provided in the fuel injection valve 1 into the combustion chamber 2.

The fuel injection valve 1 is of a center-disposed type of being disposed in the center of the combustion chamber 2. Specifically, the injection hole 11*a* is located between an intake port and an exhaust port when viewed from an axis direction of a piston of the internal combustion engine. The fuel injection valve 1 is attached to the cylinder head such that an axis direction (vertical direction in FIG. 1) of the fuel injection valve 1 is parallel to the axis direction of the piston. The fuel injection valve 1 is located on the axis of the piston or in the vicinity of an ignition plug located on the axis of the piston.

An operation of the fuel injection valve 1 is controlled by a control device 90 mounted in the vehicle. The control device 90 has at least one arithmetic processing unit (processor 90*a*) and at least one storage device (memory 90*b*) as a storage medium storing programs and data executed by the processor 90*a*. The fuel injection valve 1 and the control device 90 provide a fuel injection system.

An example of the "control device" is a computer that includes a memory that stores at least a program and at least one processor that executes the program. In this case, the computer includes at least one processor core called a CPU or the like. The memory is also called a storage medium. The memory is a non-transitory and substantive storage medium that non-temporarily stores "programs and/or data" that can be read by the processor. The storage medium is provided by a semiconductor memory, a magnetic disk, an optical disk, or the like. The program may be distributed by itself or as a storage medium in which the program is stored.

An example of the "control device" is a computer that includes digital circuits having multiple logic units, or analog circuits. In this case, the computer is called a logic circuit array or the like. The digital circuits may include a memory that stores "programs and/or data".

The fuel injection valve 1 includes an injection hole body 11, a main body 12, a fixed core 13, a non-magnetic member 14, a coil 17, a support member 18, a filter 19, a first spring member SP1 (elastic member), a cup 50, and a guide member 60, a movable portion M (refer to FIG. 3), and the like. The movable portion M is an assembly body into which a needle 20 (valve body), a movable core 30, a second spring member SP2, a sleeve 40, and the cup 50 are assembled. The injection hole body 11, the main body 12, the fixed core 13, the support member 18, the needle 20, the movable core 30, the sleeve 40, the cup 50, and the guide member 60 are made of metal.

Figure 2:
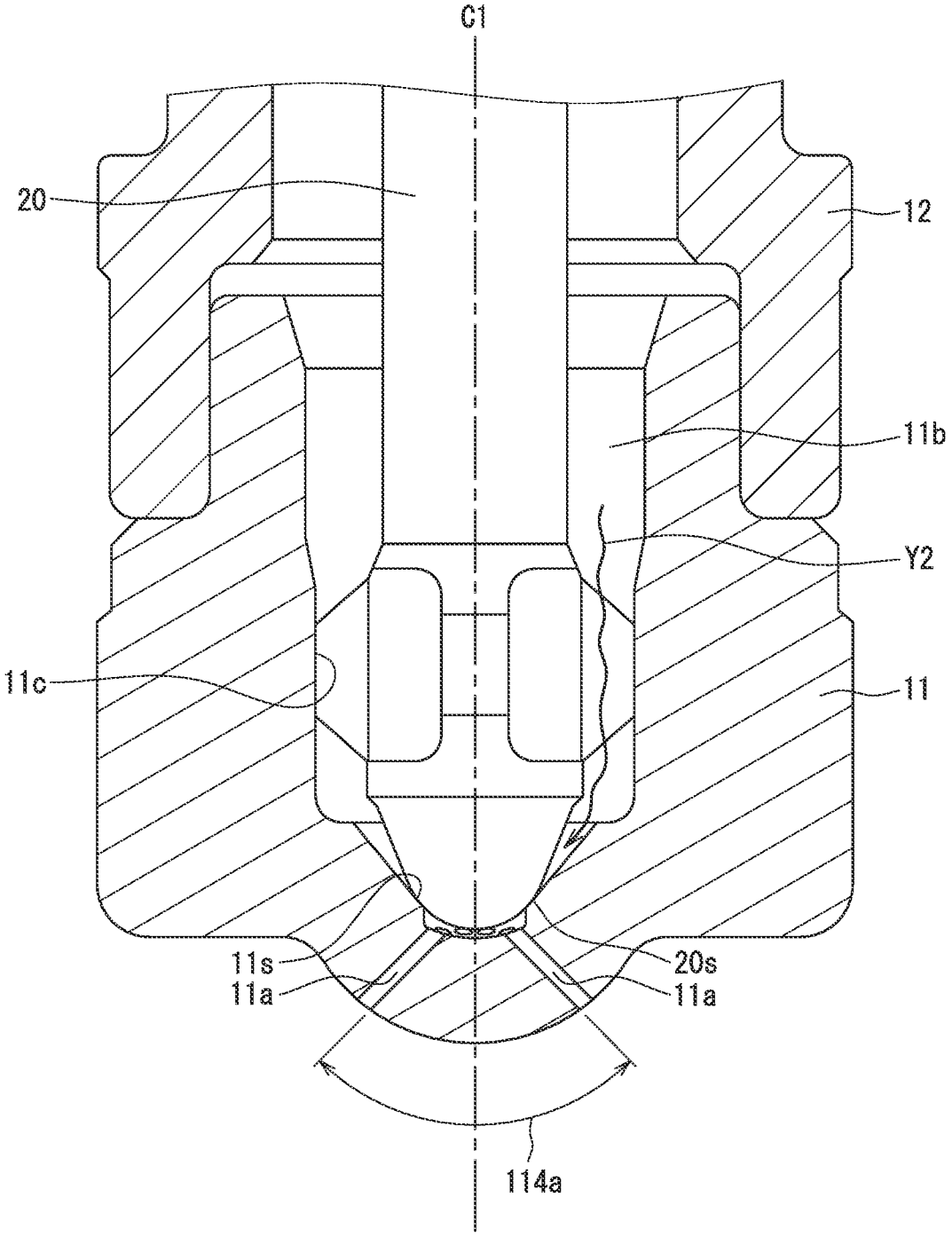
FIG. 2 is an enlarged view of an injection hole portion in FIG. 1.

As illustrated in FIG. 2, the injection hole body 11 has multiple injection holes 11*a* injecting a fuel. The injection hole 11*a* is provided by subjecting the injection hole body 11 to laser processing. The needle 20 is located inside the injection hole body 11. A fuel passage 11*b* that communicates with an inflow port 11in of the injection hole 11*a* is provided between an outer surface of the needle 20 and an inner surface of the injection hole body 11. The fuel passage 11*b* is a passage that is provided between the injection hole body 11 and the needle 20 and communicates with the inflow port 11in of the injection hole 11*a*.

A seating surface 11*s* which a seat surface 20*s* provided on the needle 20 is separated from and seated on is provided on the inner circumferential surface of the injection hole body 11. The seat surface 20*s* and the seating surface 11*s* have a shape extending in an annular shape around the central axis (axis C1) of the needle 20. When the needle 20 is separated from and seated on the seating surface 11*s*, the fuel passage 11*b* is opened and closed, and thus the injection hole 11*a* is opened and closed. Specifically, when the needle 20 comes into contact with the seating surface 11*s* and is seated thereon, the fuel passage 11*b* and the injection hole 11*a* do not communicate with each other. Then, when the needle 20 becomes distant from the seating surface 11*s* and is separated therefrom, the fuel passage 11*b* and the injection hole 11*a* communicate with each other. In this case, a fuel is injected from the injection hole 11*a*.

Figure 7:
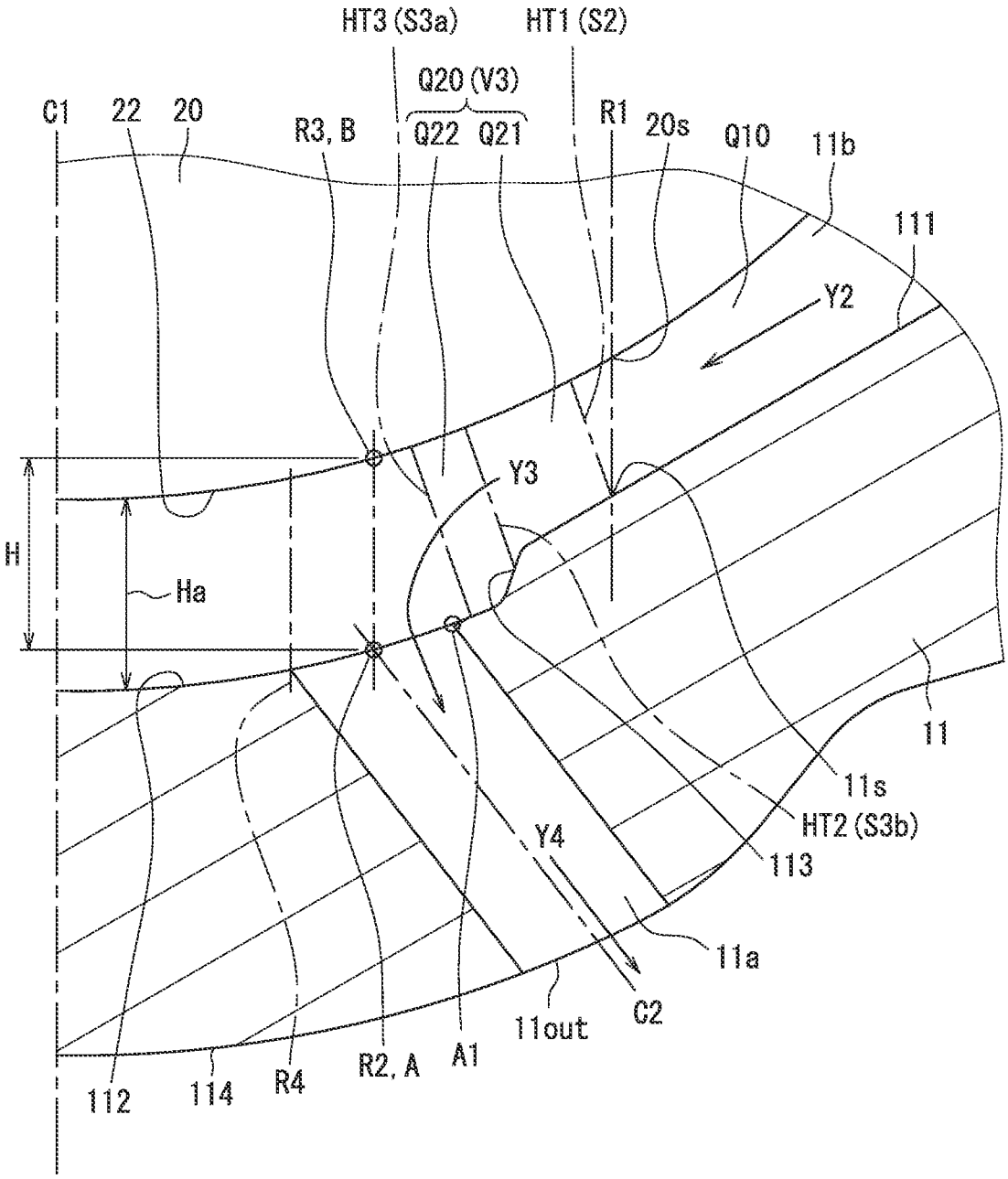
FIG. 7 is a sectional view illustrating a state in which the needle is located at a full lift position in the first embodiment.
Figure 8:
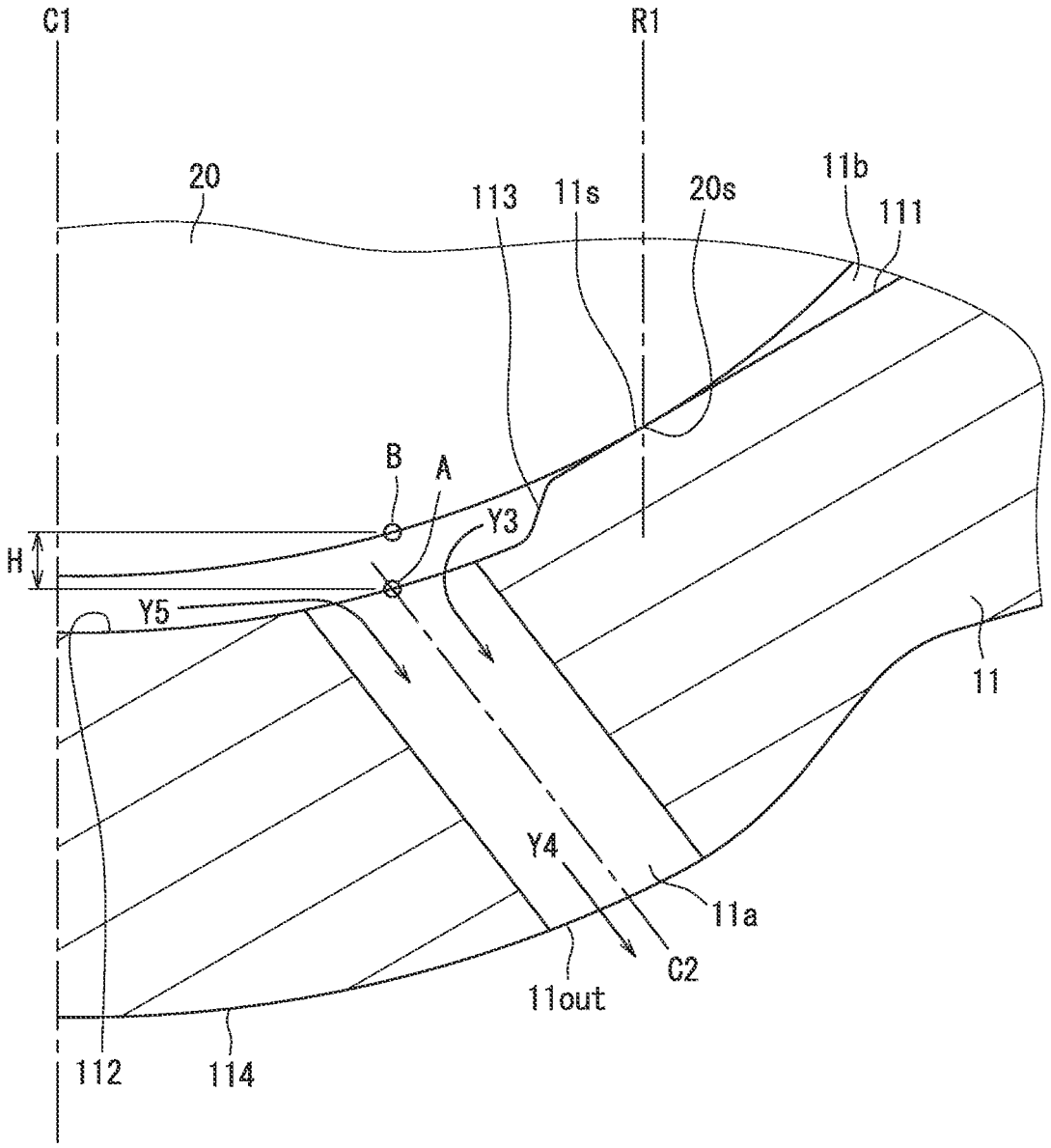
FIG. 8 is a sectional view illustrating a state in which the needle is closed in the first embodiment.
Figure 9:
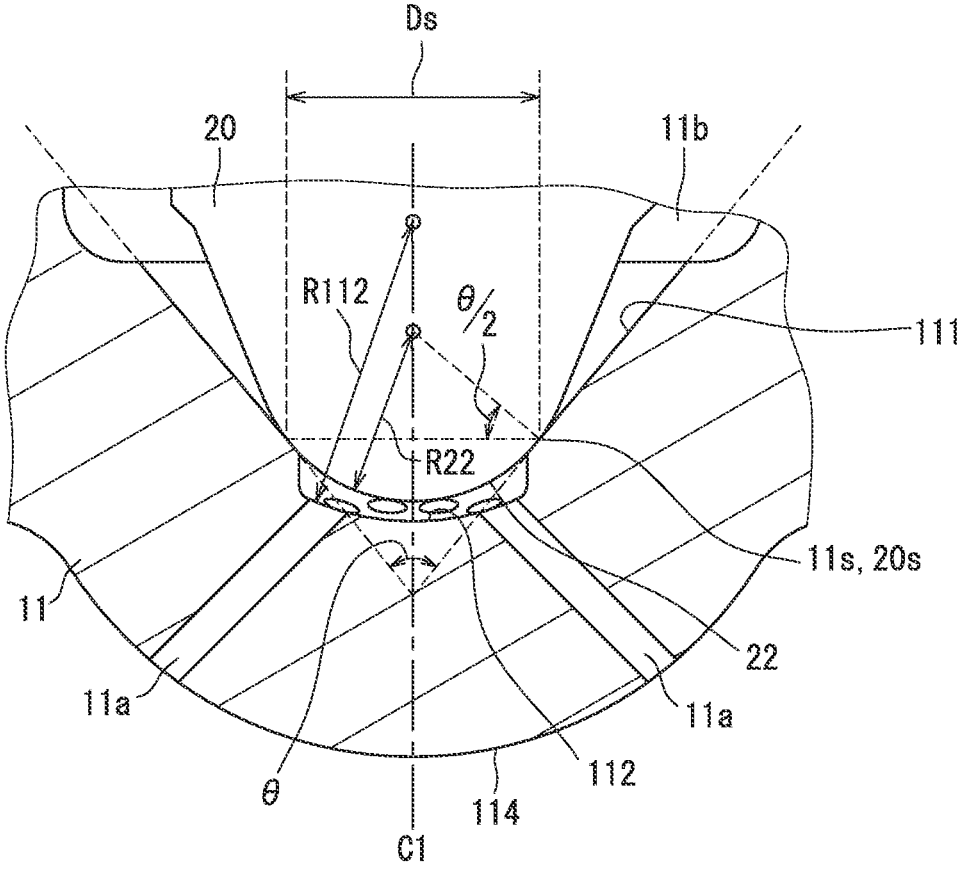
FIG. 9 is a sectional view illustrating a state in which the needle is closed in the first embodiment, and is a diagram for describing a seat angle.

At the time at which the needle 20 is closed and the seat surface 20*s* comes into contact with the seating surface 11*s*, the seat surface 20*s* and the seating surface 11*s* come into line contact with each other at a seat position R1 indicated by a dot chain line in FIGS. 7 and 8. Thereafter, when the seat surface 20*s* is pressed against the seating surface 11*s* by an elastic force of the first spring member SP1, the needle 20 and the injection hole body 11 are elastically deformed by a pressing force and thus come into surface contact with each other. A value obtained by dividing the pressing force by an area in contact with the surface is a seat surface pressure, and the first spring member SP1 is set such that a predetermined or higher seat surface pressure is secured.

Referring to FIG. 1 again, the main body 12 and the non-magnetic member 14 have a cylindrical shape. A cylindrical end that is a portion on a side (injection hole side) of the main body 12 that is closer to the injection hole 11*a* is welded and fixed to the injection hole body 11. Specifically, the outer circumferential surface of the injection hole body 11 is mounted on the inner circumferential surface of the main body 12. The main body 12 and the injection hole body 11 are welded. In the present embodiment, the outer circumferential surface of the injection hole body 11 is press-fitted into the inner circumferential surface of the main body 12. A cylindrical end that is a portion on a side (anti-injection hole side) of the main body 12 that is away from the injection hole 11*a* is welded and fixed to the cylindrical end of the non-magnetic member 14. A cylindrical end of the non-magnetic member 14 on the anti-injection hole side is fixed by being welded to the fixed core 13.

A nut member 15 is fastened to a screw portion 13N of the fixed core 13 in a state of being engaged with an engagement portion 12*c* of the main body 12. An axial force generated by this fastening causes a surface pressure by which the nut member 15, the main body 12, the non-magnetic member 14, and the fixed core 13 are pressed against each other in the axis C1 direction (vertical direction in FIG. 1). Such a surface pressure may be generated through press fitting instead of screw fastening.

The main body 12 is made of a magnetic material such as stainless steel, and has a flow path 12*b* therein through which a fuel flows to the injection hole 11*a*. The needle 20 is housed in the flow path 12*b* in a state of being movable in the axis C1 direction. The movable portion M (refer to FIG. 4), which is an assembly body into which the needle 20, the movable core 30, the second spring member SP2, the sleeve 40, and the cup 50 are assembled, is housed in a movable state in the movable chamber 12*a*.

The flow path 12*b* has a shape that communicates with the downstream side of the movable chamber 12*a* and extends in the axis C1 direction. The center lines of the flow path 12*b* and the movable chamber 12*a* coincide with the cylindrical center line (axis C1) of the main body 12. The injection hole side portion of the needle 20 is slidably supported by the inner wall surface 11*c* of the injection hole body 11, and the anti-injection hole side portion of the needle 20 is slidably supported by the inner wall surface of the cup 50. The two portions such as the upstream end and the downstream end of the needle 20 are slidably supported in this way, and thus movement of the needle 20 in the radial direction is restricted, and the tilt of the needle 20 with respect to the axis C1 of the main body 12 is restricted.

The needle 20 corresponds to a "valve body" that opens and closes the injection hole 11*a* by opening and closing the fuel passage 11*b*, is made of a magnetic material such as stainless steel, and has a shape extending in the axis C1 direction. The seat surface 20*s* described above is provided on the downstream end surface of the needle 20. When the needle 20 is moved downstream in the axis C1 direction (valve closing operation), the seat surface 20*s* is seated on the seating surface 11*s*, and the fuel passage 11*b* and the injection hole 11*a* are closed. When the needle 20 is moved upstream in the axis C1 direction (valve opening operation), the seat surface 20*s* is separated from the seating surface 11*s*, and the fuel passage 11*b* and the injection hole 11*a* are opened.

The cup 50 has a disk portion 52 having a disk shape and a cylindrical portion 51 having a cylindrical shape. The disk portion 52 has a through-hole 52*a* penetrating in the axis C1 direction. A surface of the disk portion 52 on the anti-injection hole side functions as a spring contact surface that contacts the first spring member SP1. A surface of the disk portion 52 on the injection hole side functions as a valve closing force transmission contact surface 52*c* that contacts the needle 20 and transmits a first elastic force (valve closing elastic force). The cylindrical portion 51 has a cylindrical shape extending from the outer circumferential end of the disk portion 52 toward the injection hole side. An injection hole side end surface of the cylindrical portion 51 functions as a core contact end surface 51*a* that contacts the movable core 30. An inner wall surface of the cylindrical portion 51 slides on the outer circumferential surface of the needle 20.

The fixed core 13 is made of a magnetic material such as stainless steel, and has a flow path 13*a* therein through which the fuel flow to the injection hole 11*a*. The flow path 13*a* has a shape that communicates with an internal passage 20*a* (refer to FIG. 3) provided inside the needle 20 and the upstream side of the movable chamber 12*a* and extends in the axis C1 direction. The guide member 60, the first spring member SP1, and the support member 18 are housed in the flow path 13*a*.

The support member 18 has a cylindrical shape and is press-fitted and fixed to the inner wall surface of the fixed core 13. The first spring member SP1 is a coil spring disposed on the downstream side of the support member 18, and is elastically deformed in the axis C1 direction. An upstream end surface of the first spring member SP1 is supported by the support member 18, and a downstream end surface of the first spring member SP1 is supported by the cup 50. The cup 50 is biased to the downstream side by a force (first elastic force) generated due to the elastic deformation of the first spring member SP1. A press-fitting amount of the support member 18 in the axis C1 direction is adjusted, and thus a magnitude (first set load) of the elastic force for biasing the cup 50 is adjusted.

The filter 19 captures foreign matter contained in the fuel supplied to the fuel injection valve 1. The filter 19 is press-fitted and fixed to a portion of the inner wall surface of the fixed core 13 on the upstream side of the support member 18. The filter 19 has a cylindrical shape, and, as indicated by an arrow Y1 in FIG. 1, the fuel flowing into the cylinder from the cylinder axis direction of the filter 19 flows in the cylinder radial direction of the filter 19 and passes through the filter 19.

Figure 3:
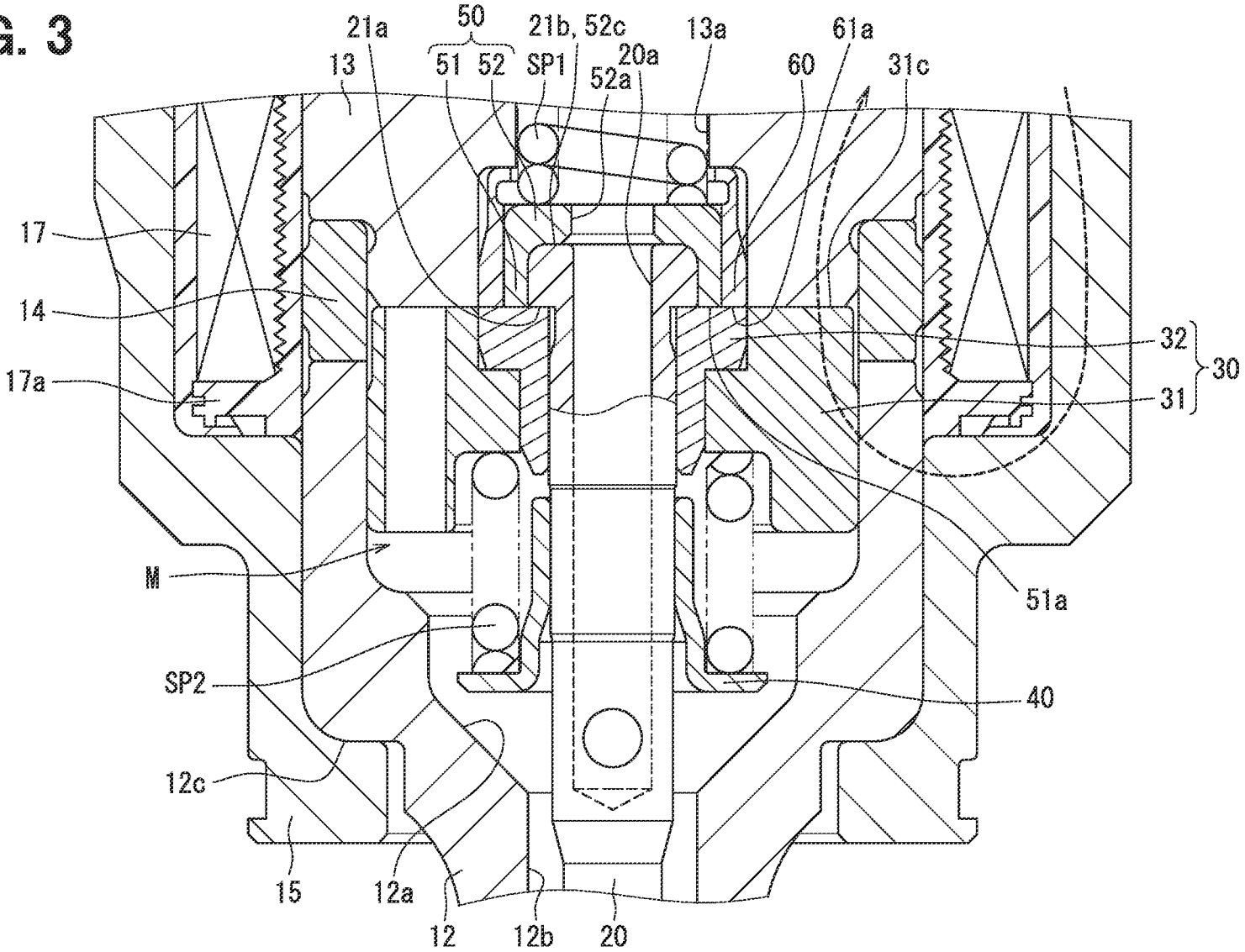
FIG. 3 is an enlarged view of a movable core portion in FIG. 1.

As illustrated in FIG. 3, the guide member 60 has a cylindrical shape made of a magnetic material such as stainless steel, and is press-fitted and fixed to the fixed core 13. An injection hole side end surface of the guide member 60 functions as a stopper contact end surface 61*a* that contacts the movable core 30. An inner wall surface of the guide member 60 slides on an outer circumferential surface 51*d* of the cylindrical portion 51 related to the cup 50. In summary, the guide member 60 has a guide function for sliding on the outer circumferential surface of the cup 50 moved in the axis C1 direction and a stopper function for restricting movement of the movable core 30 toward the anti-injection hole side in contact with the movable core 30 moved in the axis C1 direction.

A resin member 16 is provided on the outer circumferential surface of the fixed core 13. The resin member 16 has a connector housing 16*a*, and a terminal 16*b* is housed inside the connector housing 16*a*. The terminal 16*b* is electrically connected to the coil 17. An external connector (not illustrated) is connected to the connector housing 16*a*, and power is supplied to the coil 17 through the terminal 16*b*. The coil 17 is wound around an electrically insulating bobbin 17*a* to form a cylindrical shape, and is disposed radially outside the fixed core 13, the non-magnetic member 14, and the movable core 30. The fixed core 13, the nut member 15, the main body 12, and the movable core 30 form a magnetic circuit through which a magnetic flux generated by supplying electric power (energization) to the coil 17 flows (refer to a dotted arrow in FIG. 3).

As illustrated in FIG. 3, the movable core 30 is disposed on the injection hole side with respect to the fixed core 13 and is housed in the movable chamber 12*a* in a state of being movable in the axis C1 direction. The movable core 30 has an outer core 31 and an inner core 32. The outer core 31 has a cylindrical shape made of a magnetic material such as stainless steel, and the inner core 32 has a cylindrical shape made of a non-magnetic material such as stainless steel. The outer core 31 is press-fitted and fixed to the outer circumferential surface of the inner core 32.

The needle 20 is inserted into and disposed inside the cylinder of the inner core 32. The inner core 32 is assembled to the needle 20 in a state being slidable on the needle 20 in the axis C1 direction. The inner core 32 contacts the guide member 60, the cup 50, and the needle 20 as stopper members. Therefore, the inner core 32 is made of a material having a higher hardness than that of the outer core 31. The outer core 31 has a core facing surface 31*c* facing the fixed core 13, and a gap is provided between the core facing surface 31*c* and the fixed core 13. Therefore, in a state in which the coil 17 is energized and the magnetic flux flows as described above, a magnetic attraction force attracted to the fixed core 13 acts on the outer core 31 due to the provided gap.

The sleeve 40 is press-fitted and fixed to the needle 20 to support an injection hole side end surface of the second spring member SP2. The second spring member SP2 is a coil spring that is elastically deformed in the axis C1 direction. An anti-injection hole side end surface of the second spring member SP2 is supported by the outer core 31. The outer core 31 is biased to the anti-injection hole side by a force (second elastic force) generated due to the elastic deformation of the second spring member SP2. A press-fitting amount of the sleeve 40 in the axis C1 direction is adjusted, and thus a magnitude (second set load) of the second elastic force that biases the movable core 30 when the valve is closed is adjusted. The second set load related to the second spring member SP2 is smaller than the first set load related to the first spring member SP1.

DESCRIPTION OF OPERATION

Next, an operation of the fuel injection valve 1 will be described with reference to FIG. 4.

Figure 4:
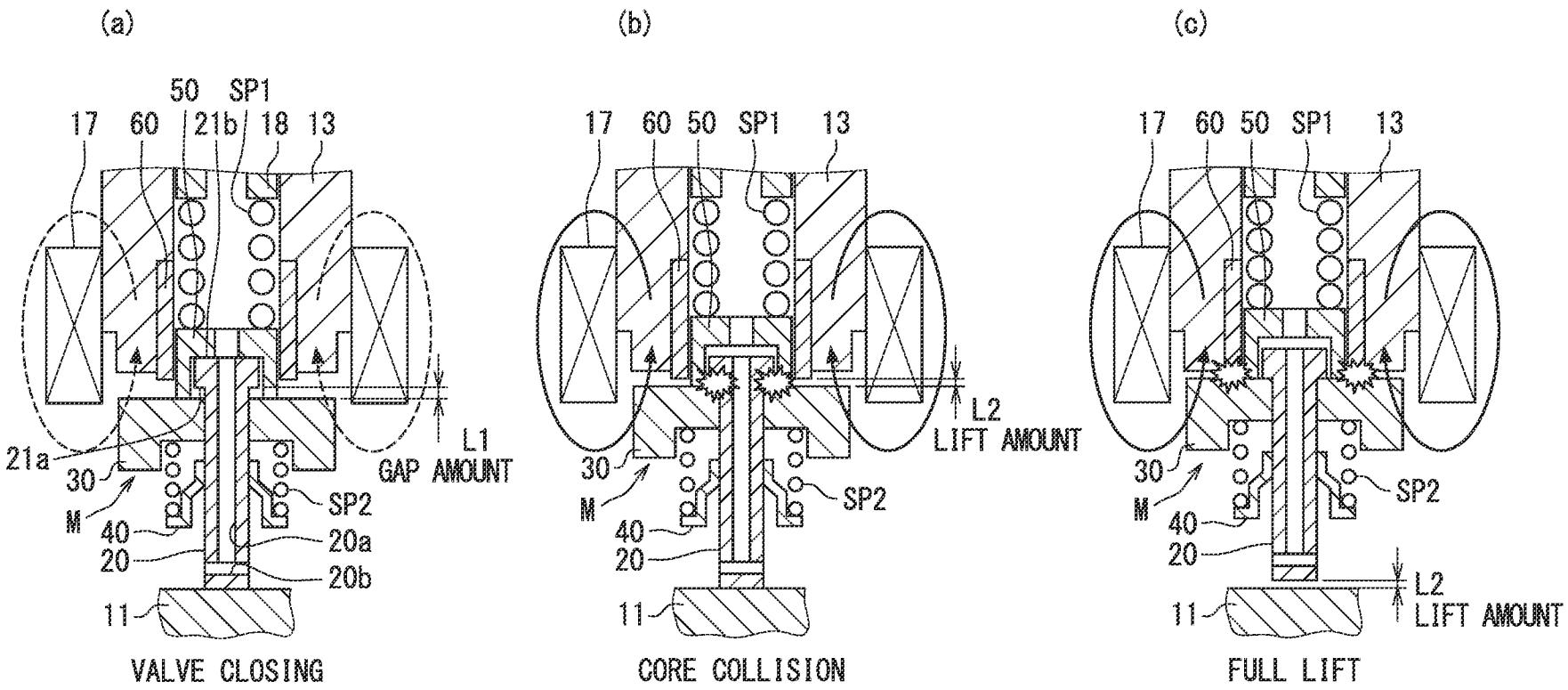
FIG. 4 is a schematic diagram illustrating an operation of the fuel injection valve according to the first embodiment, in which (a) illustrates a valve closed state, (b) illustrates a state in which a movable core that is moved by a magnetic attraction force collides with a valve body, and (c) illustrates a state in which the movable core that is further moved by the magnetic attraction force collides with a guide member.

As illustrated in the (a) part in FIG. 4, the magnetic attraction force is not generated in a state in which the energization of the coil 17 is turned off, and thus the magnetic attraction force does not act on the movable core 30 biased to the valve opening side. The cup 50 biased to the valve closing side by the first elastic force of the first spring member SP1 comes into contact with a valve body contact surface 21*b* (refer to FIG. 3) of the needle 20 when being closed and the inner core 32, and transmits the first elastic force thereto.

The movable core 30 is biased to the valve closing side by the first elastic force of the first spring member SP1 transmitted from the cup 50, and is also biased to the valve opening side by the second elastic force of the second spring member SP2. Since the first elastic force is greater than the second elastic force, the movable core 30 is pushed by the cup 50 to enter a state of being moved (lifted down) to the injection hole side. The needle 20 is biased to the valve closing side by the first elastic force transmitted from the cup 50, and is pushed by the cup 50 to enter a state of being moved (lifted down) to the injection hole side, that is, a state of being seated on the seating surface 11*s* and closed. In this valve closed state, the gap is provided between a valve body contact surface 21*a* (refer to FIG. 3) of the needle 20 when being opened and the inner core 32, and a length of the gap in the axis C1 direction in the valve closed state is defined as a gap amount L1.

As illustrated in the (b) part in FIG. 4, in a state immediately after the energization of the coil 17 is switched from Off to On, the magnetic attraction force biased to the valve opening side acts on the movable core 30, and thus the movable core 30 starts to be moved to the valve opening side. When the movable core 30 is moved while pushing up the cup 50 and a movement amount reaches the gap amount L1, the inner core 32 collides with the valve body contact surface 21*a* of the needle 20 when being opened. At the time of this collision, a gap is provided between the guide member 60 and the inner core 32, and a length of this gap in the axis C1 direction will be referred to as a lift amount L2.

During the period up to the point of collision, the valve closing force due to the fuel pressure applied to the needle 20 is not applied to the movable core 30, and thus a collision speed of the movable core 30 can be increased accordingly. Since such a collision force is added to the magnetic attraction force to be used as a valve opening force for the needle 20, the needle 20 can be operated to be opened even with a high-pressure fuel while suppressing an increase in the magnetic attraction force required for valve opening.

After the collision, the movable core 30 further continues to be moved by the magnetic attraction force, and, when a movement amount after the collision reaches the lift amount L2, the inner core 32 collides with the guide member 60 as illustrated in the (c) part in FIG. 4 to stop the movement. A separation distance between the seating surface 11*s* and the seat surface 20*s* in the axis C1 direction at the time of stopping the movement corresponds to a full lift amount of the needle 20 and coincides with the lift amount L2 described above.

Thereafter, when the energization of the coil 17 is switched from On to Off, the magnetic attraction force decreases as a drive current decreases, and thus the movable core 30 starts movement to the valve closing side together with the cup 50. The needle 20 is pushed by the pressure of the fuel filled between the needle 20 and the cup 50, and starts lift-down (valve closing operation) at the same time as the movement start of the movable core 30.

Thereafter, at the time at which the needle 20 is lifted down by the lift amount L2, the seat surface 20*s* is seated on the seating surface 11*s*, and the flow path 11*b* and the injection hole 11*a* are closed. Thereafter, the movable core 30 continues to be moved to the valve closing side together with the cup 50, and the cup 50 stops the movement to the valve closing side at the time at which the cup 50 comes into contact with the needle 20. Thereafter, the movable core 30 further continues to be moved to the valve closing side (inertial movement) by the inertial force, and then is moved (rebounded) to the valve opening side by the elastic force of the second spring member SP2. Thereafter, the movable core 30 collides with the cup 50 to be moved (rebounded) to the valve opening side together with the cup 50, but is quickly pushed back by the valve closing elastic force to converge to the initial state illustrated in the (a) part in FIG. 4.

Therefore, the smaller the rebound and the shorter the time required for convergence, the shorter the time from the end of injection to the return to the initial state. Thus, when executing multi-stage injection in which a fuel is injected multiple times per combustion cycle of the internal combustion engine, an injection interval can be shortened and the number of times of injection included in the multi-stage injection can be increased. The convergence time is reduced as described above, and thus it is possible to control an injection amount with high accuracy when partial lift injection described below is executed. The partial lift injection is minute amount injection due to a short valve opening time by stopping the energization of the coil 17 and starting a valve closing operation before the needle 20 operated to be opened reaches the full lift position (maximum valve opening position).

On and Off of the energization described above are controlled by the processor 90*a* executing the program stored in the memory 90*b*. Fundamentally, the processor 90*a* calculates a fuel injection amount in one combustion cycle, an injection timing, and the number of times of injection related to the multi-stage injection based on a load and a rotation speed of the internal combustion engine. The processor 90*a* executes various programs to execute the multi-stage injection control, partial lift injection control (PL injection control), compression stroke injection control, and pressure control described below. The control device 90 when executing such control corresponds to a multi-stage injection control unit 91, a partial lift injection control unit (PL injection control unit 92), a compression stroke injection control unit 93, and a pressure control unit 94 illustrated in FIG. 1.

The multi-stage injection control unit 91 controls On and Off of energization of the coil 17 such that the fuel is injected multiple times from the injection hole 11*a* during one combustion cycle of the internal combustion engine. The PL injection control unit 92 controls On and Off of energization of the coil 17 such that the valve closing operation is started before the needle 20 reaches the full lift position after the needle 20 is separated from the seating surface 11*s*. For example, as the number of times of multi-stage injection increases, the injection amount related to one injection becomes a very small amount. Therefore, in the case of such a minute amount of injection, PL injection control is executed.

The compression stroke injection control unit 93 controls On and Off of energization of the coil 17 such that the fuel is injected from the injection hole 11*a* during a period including a part of the compression stroke period of the internal combustion engine. When the fuel is injected into the combustion chamber 2 during the compression stroke period in above-described way, the time from the injection start timing to the ignition timing is short, and thus the time for sufficiently mixing the fuel and air is short. Thus, this type of fuel injection valve 1 is required to inject the fuel from the injection hole 11*a* in a state of high penetration force in order to promote the mixing of the fuel and air. It is required to increase the injection pressure in order to split the spray in a short time.

The pressure control unit 94 controls the pressure (supply fuel pressure) of the fuel supplied to the fuel injection valve 1 to any target pressure within a predetermined range. Specifically, the supply fuel pressure is controlled by controlling a fuel discharge amount from the above-described fuel pump. In a case where a force at which the needle 20 is pressed against the seating surface 11*s* by the fuel pressure when the target pressure is set to the minimum value in the predetermined range is defined as a minimum fuel pressure valve closing force, the first elastic force (valve closing elastic force) caused by the first spring member SP1 is set to be smaller than the minimum fuel pressure valve closing force.

Detailed Description of Fuel Passage 11*b*

Hereinafter, the details of the fuel passage 11*b* will be described with reference to FIGS. 5 to 10. The fuel passage 11*b* includes at least a space between a tapered surface 111, a body bottom surface 112, and a connecting surface 113, and a valve body tip surface 22, which will be described later. The fuel flowing through the fuel passage 11*b* flows toward the seat surface 20*s* as indicated by an arrow Y2 in FIG. 5, and then passes through a gap (seat gap) between the seat surface 20*s* and the seating surface 11*s*. The fuel until reaching the seat gap flows toward the axis C1. As indicated by an arrow Y3, the fuel that has passed through the seat gap changes in an orientation thereof to be away from the axis C1 and flows into the inflow port 11in of the injection hole 11*a*. The fuel flowing in from the inflow port 11in is rectified in the injection hole 11*a* and is injected into the combustion chamber 2 from an outflow port 11out of the injection hole 11*a* as indicated by an arrow Y4. In addition to a fuel that changes the orientation to be away from the axis C1 and flows into the inflow port 11in (refer to the arrow Y3), there is also a fuel flowing into the inflow port 11in from a sack chamber Q22 as indicated by an arrow Y5 in FIG. 8.

Figure 6:
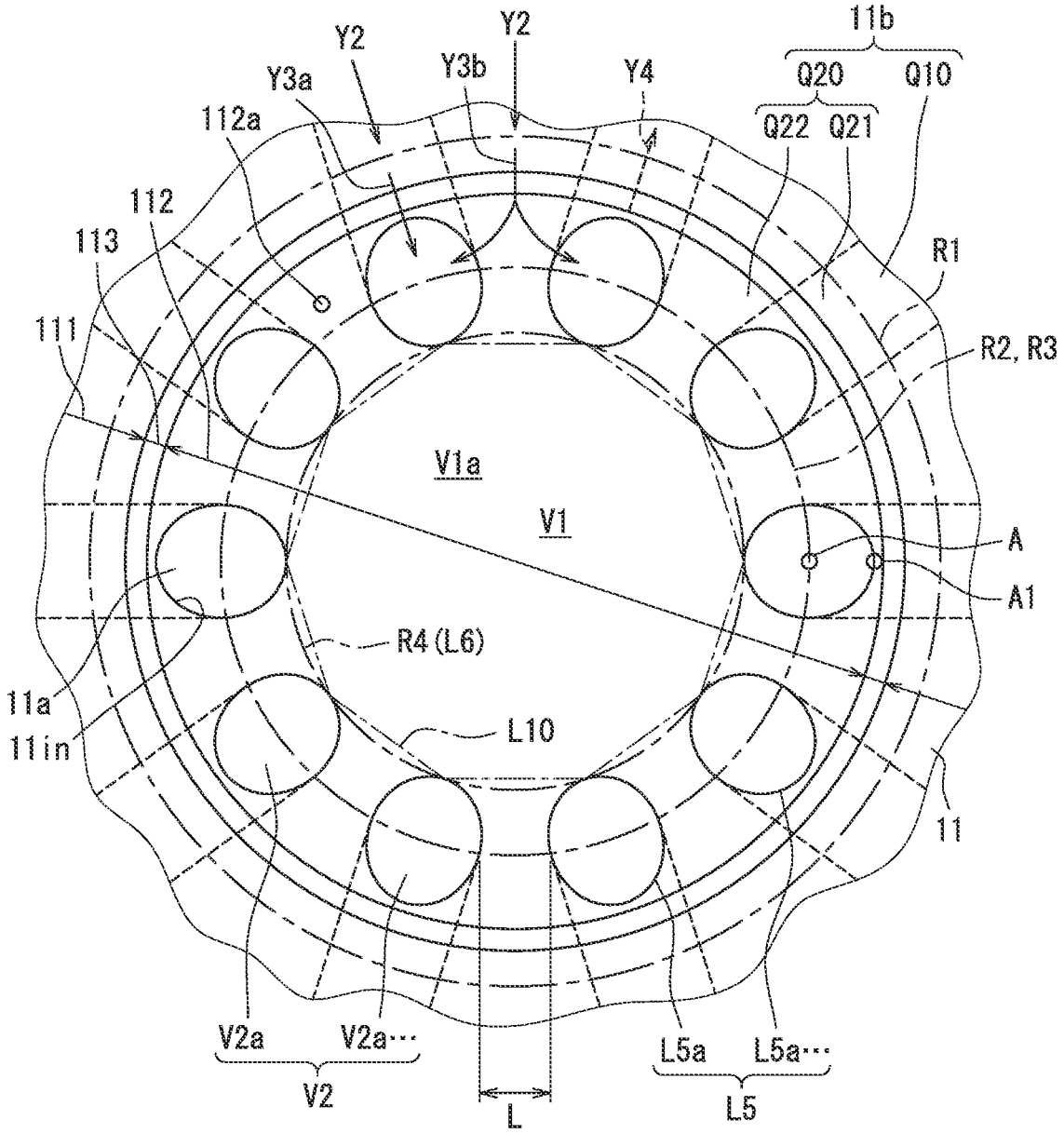
FIG. 6 is a top view in which the injection hole body according to the first embodiment is viewed from an inflow port side of the injection hole.

As illustrated in FIG. 6, the inflow ports 11in of the multiple injection holes 11*a* are disposed at equal intervals on a virtual circle (inflow center virtual circle R2) centered on the axis C1. The shapes and sizes of the multiple injection holes 11*a* are all the same. Specifically, the injection hole 11*a* has a perfect circular shape as a passage cross section from the inflow port 11in to the outflow port 11out, and has the same straight shape without a diameter of the perfect circular shape being changed. The passage cross section mentioned here is a cross section cut perpendicularly to the axis C2 passing through the center of the injection hole 11*a*.

The shape of the inflow port 11in and the outflow port 11out is an elliptical shape having, as a major axis, an orientation thereof in the radial direction centered on the axis C1. As illustrated in FIG. 7, an intersection between a sack surface (body bottom surface 112) on which the injection hole 11*a* is provided and the injection hole axis (axis C2) is defined as an inflow port center point A. A point where the line parallel to the axis C1 passing through the inflow port center point A intersects the outer surface of the needle 20 is defined as an inflow center facing point B. As illustrated in FIG. 6, a circle passing through the inflow port center points A of the multiple injection holes 11*a* corresponds to the above-described inflow center virtual circle R2. A circle connecting the multiple inflow center facing points B is a facing virtual circle R3. The inflow center virtual circle R2 and the facing virtual circle R3 coincide with each other when viewed from the axis C1 direction.

As illustrated in FIG. 6, among the multiple injection holes 11*a* arranged around the axis C1, a size of an interval between the inflow ports 11in of the adjacent injection holes 11*a* is defined as an inter-injection hole distance L. The inter-injection hole distance L is a length along the inflow center virtual circle R2.

As illustrated in FIGS. 7 and 8, a distance between the needle 20 and the injection hole body 11 in the direction in which the needle 20 is separated and seated, that is, in the axis C1 direction, is defined as a valve body separation distance Ha. More specifically, a surface including the seat surface 20*s* and the portion on the downstream side of the seat surface 20*s* of the outer surface of the needle 20 is defined as a valve body tip surface 22. A distance between the body bottom surface 112 and the valve body tip surface 22 in the axis C1 direction is defined as the valve body separation distance Ha.

A size of the gap between the outer surface of the needle 20 and the inflow port 11in in the axis C1 direction is defined as an inflow port gap distance H. That is, the valve body separation distance Ha at the inflow port 11in, more specifically, the valve body separation distance Ha at the portion of the inflow port 11in farthest from the axis C1, that is, the portion indicated by reference sign A1 in FIGS. 6 and 7, corresponds to the inflow port gap distance H.

The inter-injection hole distance L, which is defined as the length along the inflow center virtual circle R2 between the injection holes, is smaller than the inflow port gap distance H, and a second inter-injection hole distance described below is also smaller than the inflow port gap distance H. The second inter-injection hole distance is defined as the shortest straight line length between the outer circumferential edges of the adjacent inflow ports 11in.

The inter-injection hole distance L is smaller than the inflow port gap distance H defined as the valve body separation distance Ha at the portion indicated by the reference sign A1, and, with respect to a second inflow port gap distance described below, the inter-injection hole distance L is also smaller than the second inflow port gap distance. The second inflow port gap distance is defined as the valve body separation distance Ha at the inflow port center point A. The second inter-injection hole distance is set to be smaller than the second inflow port gap distance.

The inter-injection hole distance L is smaller than the inflow port gap distance H. Specifically, the inter-injection hole distance L is smaller than the inflow port gap distance H in a state in which the needle 20 is separated up to the position farthest from the seating surface 11*s*, that is, at the full lift position. The full lift position is a position of the needle 20 in the axis C1 direction in a state in which the inner core 32 comes into contact with the stopper contact end surface 61*a*, and the valve body contact surface 21*a* at the time of valve opening is come into contact with the inner core 32.

The inter-injection hole distance L is smaller than the inflow port gap distance H in a state in which the needle 20 is seated on the seating surface 11*s*, that is, in a valve closed state. The inter-injection hole distance L is smaller than a diameter of the inflow port 11in. When the inflow port 11in has an elliptical shape, a short side of the elliptical shape is regarded as the diameter of the inflow port 11in.

In the fuel passage 11*b* provided between the inner surface of the injection hole body 11 and the outer surface of the needle 20, a portion on the upstream side of the seating surface 11*s* and the seat surface 20*s* is defined as a seat upstream passage Q10, and a portion on the downstream side of the seating surface 11*s* and the seat surface 20*s* is defined as a seat downstream passage Q20. The seat downstream passage Q20 has a tapered chamber Q21 and a sack chamber Q22.

As illustrated in FIG. 7, a portion of the inner surface of the injection hole body 11 including the seating surface 11*s*, which forms a part of the seat upstream passage Q10 and the entire tapered chamber Q21, is defined as the tapered surface 111. The tapered surface 111 has a linear shape in a cross section including the axis C1, a shape extending in a direction intersecting the axis C1, and an annular shape when viewed in the axis C1 direction (refer to FIG. 6).

A portion of the inner surface of the injection hole body 11 including the axis C1, which forms the sack chamber Q22, is defined as the body bottom surface 112, and a portion that connects the body bottom surface 112 to the tapered surface 111 is defined as the connecting surface 113. The connecting surface 113 has a linear shape in the cross section including the axis C1, a shape extending in the direction intersecting the axis C1, and an annular shape when viewed in the axis C1 direction (refer to FIG. 6). More specifically, a boundary between the connecting surface 113 and the tapered surface 111 and a boundary between the connecting surface 113 and the body bottom surface 112 have a curved shape in the cross section including the axis C1.

The valve body tip surface 22 has a shape that is curved to be swollen toward the body bottom surface 112. A curvature radius R22 (refer to FIG. 9) of the valve body tip surface 22 is the same over the entire valve body tip surface 22. The curvature radius R22 is smaller than a seat diameter Ds that is a diameter of the seat surface 20*s* at the seat position R1, and is larger than the seat radius.

The body bottom surface 112 has a shape that is curved to be recessed toward the valve body tip surface 22, that is, a shape that is curved in the same orientation as the valve body tip surface 22. A curvature radius R112 (refer to FIG. 9) of the body bottom surface 112 is the same over the body bottom surface 112. The curvature radius R112 of the body bottom surface 112 is larger than the curvature radius R22 of the valve body tip surface 22. Therefore, the valve body separation distance Ha becomes continuously smaller from the circumferential edge of the inflow center virtual circle R2 toward the axis C1 in the radial direction.

Figure 10:
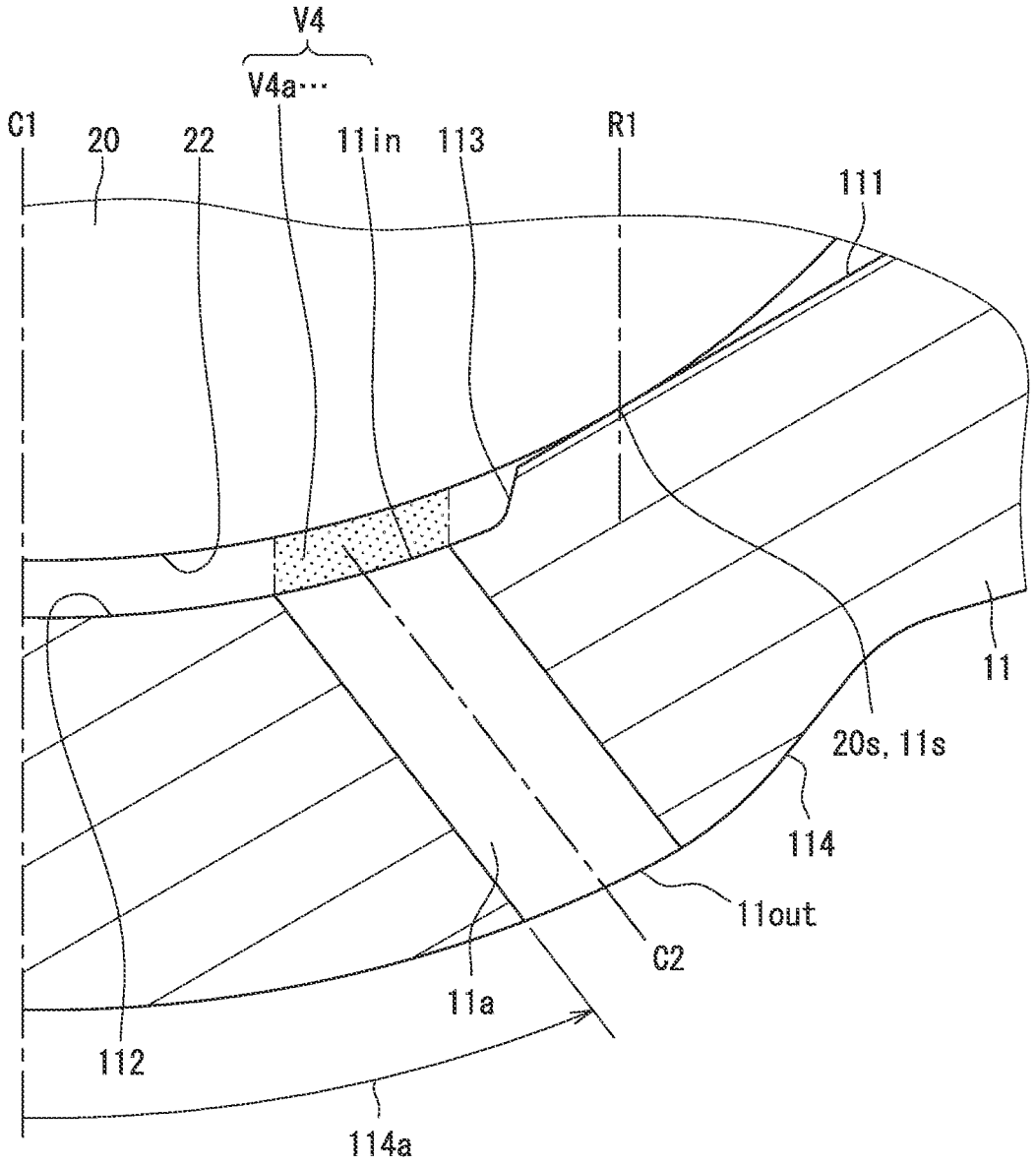
FIG. 10 is a sectional view of the injection hole body and the needle according to the first embodiment, and is a diagram for describing a volume directly above the injection hole.

In the body outer surface 114 that is the outer surface of the injection hole body 11, a region radially inside the outflow port 11out is defined as an outer surface central region 114*a* (refer to FIG. 10). The outer surface central region 114*a* has a shape curved in the same orientation as the body bottom surface 112. A curvature radius of the outer surface central region 114*a* is the same over the entire outer surface central region 114*a*. Under the condition that the center of the curvature radius is present at the same location, the curvature radius of the outer surface central region 114*a* is larger than the curvature radius R112 of the body bottom surface 112. A thickness dimension of the body outer surface 114 is uniform in the outer surface central region 114*a*. That is, a length of the body outer surface 114 in the curvature radius direction is uniform in the outer surface central region 114*a*.

A surface roughness of the portion of the injection hole body 11 forming the fuel passage 11*b* is coarser than a surface roughness of the portion forming the injection hole 11*a*. Specifically, the surface roughness of the body bottom surface 112 is coarser than the surface roughness of the inner wall surface of the injection hole 11*a*. The injection hole 11*a* is formed through laser processing, while the inner surface of the injection hole body 11 is formed through cutting.

A cylinder obtained by causing a virtual circle that is tangent to portions of the circumferential edges of the respective multiple inflow ports 11in closest to the axis C1 in the radial direction and is centered on the axis C1 to extend straight along the axis C1 direction from the body bottom surface 112 to the valve body tip surface 22 is defined as a virtual cylinder. A volume of a portion of the fuel passage 11*b* surrounded by the virtual cylinder, the body bottom surface 112, and the valve body tip surface 22 is defined as a central column volume V1*a* (refer to FIG. 6). In the circumferential edge of each of the multiple inflow ports 11in, in the radial direction, a region surrounded by a straight line connecting portions closest to the axis C1 is defined as a virtual region, a volume of the virtual region extending from the injection hole body 11 to the needle 20 in the axis C1 direction is defined as a central prism volume V1. The central column volume V1*a* and the central prism volume V1 do not include a volume V2*a* of the injection hole 11*a*.

The virtual circle according to the present embodiment is a virtual inscribed circle R4 inscribed in the multiple inflow ports 11in. A volume of all portions of the fuel passage 11*b* on the downstream side of the seating surface 11*s*, that is, a volume of the seat downstream passage Q20 is defined as a seat downstream volume V3 (refer to FIG. 7). As described above, the seat downstream passage Q20 has the tapered chamber Q21 and the sack chamber Q22. Therefore, the volume of all portions of the fuel passage 11*b* on the downstream side of the seating surface 11*s* is a total volume of the tapered chamber Q21 and the sack chamber Q22. The central prism volume V1, the central column volume V1*a*, and the seat downstream volume V3 change according to the lift amount L2 of the needle 20, and become the maximum when the lift amount L2 is the maximum.

A sum of the volumes V2*a* of the multiple injection holes 11*a* is defined as a total injection hole volume V2. In the present embodiment, ten injection holes 11*a* are provided, and the volumes V2*a* of all the injection holes 11*a* are the same. Therefore, a value ten times the volume V2*a* of one injection hole 11*a* corresponds to the total injection hole volume V2. The volume V2*a* of the injection hole 11*a* corresponds to a volume of the region of the injection hole 11*a* between the inflow port 11in and the outflow port 11out. The volume V2*a* of the injection hole 11*a* may be calculated based on a tomographic image of the injection hole body 11 obtained through, for example, irradiation with X-rays. Similarly, other volumes defined in this present embodiment may be calculated based on tomographic images.

The total injection hole volume V2 is larger than the central prism volume V1 in a state in which the needle 20 is seated on the seating surface 11*s*, and is larger than the central prism volume V1 in a state in which the needle 20 is farthest from the seating surface 11*s* (that is, in the full lift state). The total injection hole volume V2 is larger than the seat downstream volume V3 in the seated state and larger than the seat downstream volume V3 in the full lift state. Similarly to the central prism volume V1, the central column volume V1*a* is smaller than the total injection hole volume V2 in both the full lift state and the seated state.

The portion marked with dots in FIG. 10 corresponds to a columnar space (region directly above the injection hole) extending straight from the inflow port 11in along the axis C1 direction in the fuel passage 11*b*. In the fuel passage 11*b*, a volume of the region directly above the injection hole is defined as a volume V4*a* directly above the injection hole, and a sum of the volumes V4*a* directly above the injection holes of the multiple injection holes 11*a* is as a total volume V4 directly above the injection hole. The total volume V4 directly above the injection hole is larger than the central prism volume V1. The central column volume V1*a* is also smaller than the total volume V4 directly above the injection hole in the same manner as the central prism volume V1.

A sum of circumferential edge lengths L5*a* (refer to FIG. 6) of the inflow ports 11in of the multiple injection holes 11*a* is defined as a total circumferential edge length L5. In the present embodiment, since ten injection holes 11*a* are provided, and the circumferential edge lengths L5*a* of all the injection holes 11*a* are substantially the same. Therefore, a value ten times the circumferential edge length L5*a* of one injection hole 11*a* corresponds to the total circumferential edge length L5. A circumferential length of a virtual circle that is tangent to portions of the circumferential edges of the respective multiple inflow ports 11in closest to the axis C1 in the radial direction and is centered on the axis C1, that is, a circumferential length of the virtual inscribed circle R4 described above is a virtual circumferential length L6. The total circumferential edge length L5 is larger than the virtual circumferential length L6.

A tangential direction of the valve body tip surface 22 at the seat position R1 is the same as a tangential direction of the tapered surface 111 at the seat position R1. The valve body tip surface 22 has a curved shape in the cross section including the axis C1, while the tapered surface 111 has a linear shape in the cross section including the axis C1. An apex angle at an apex where extension lines of the tapered surface 111 intersect each other is defined as a seat angle θ (refer to FIG. 9). That is, the seating surface 11*s* is a conical surface represented by two straight lines in the above cross section, and an angle formed between the two straight lines is the seat angle θ. The seat angle θ is set to an angle of 90 degrees or less, more specifically, an angle smaller than 90 degrees. An intersection angle between the tapered surface 111 and the axis C1 in the cross section including the axis C1 is a half (θ/2) of the seat angle θ, and the intersection angle is greater than an intersection angle between the connecting surface 113 and the axis C1 in the cross section including the axis C1.

Deposit Countermeasures

By the way, at the time at which the needle 20 is lifted down and seated on the seating surface 11*s*, a fuel still remains in the seat downstream passage Q20, and the remaining fuel flows out of the injection hole 11*a* immediately after seating. Specifically, a fuel flow velocity in the injection hole 11*a* at the time of seating does not immediately become zero, and the fuel continues to flow even immediately after the valve is closed due to inertia, and a fuel in the seat downstream passage Q20 is attracted to the fuel flowing in the injection hole 11*a* due to inertia. More specifically, in the sack chamber Q22, the fuel present in the portion of the volume V4*a* directly above the injection hole has a high flow velocity, and a fuel present around the portion of the volume V4*a* directly above the injection hole can be attracted to in the flow (mainstream) of the fuel. Since the fuel attracted in above-described way is vigorously ejected from the injection hole 11*a* at a high flow velocity, the fuel ejected in this way is unlikely to adhere to the body outer surface 114.

However, the momentum of the fuel ejected becomes weaker with the passage of time from the time of seating, and the fuel that leaks out of the outflow port 11out due to its own weight tends to adhere to the portion of the body outer surface 114 around the outflow port 11out. The leaked fuel adhering to the body outer surface 114 in this way is easily altered by the heat of the combustion chamber and fixed as a deposit. When such a deposit is accumulated and increased, a spray shape or an injection amount of the fuel injected from the injection hole 11*a* becomes different from the intention.

Focusing on this point, in the present embodiment, the valve body separation distance Ha, which is a distance between the valve body tip surface 22 and the injection hole body 11 in the axis C1 direction, continuously becomes smaller toward the axis C1 in the radial direction from the circumferential edge of the inflow center virtual circle R2. Therefore, contrary to this configuration, compared with a case where the valve body separation distance Ha is uniform regardless of a radial position or becomes larger toward the axis C1, a fuel in the portion radially inside the seat downstream passage Q20 is easily attracted to the inflow port 11in of the injection hole 11*a*. Therefore, since it is possible to reduce an amount of a fuel remaining without being able to be vigorously ejected from the injection hole 11*a* at a high flow velocity along with the mainstream, the fuel adhering to the body outer surface 114 or the inner surface of the injection hole 11*a* can be reduced, and thus a deposit can be restricted from accumulating on the injection hole body 11.

In the present embodiment, the surface of the injection hole body 11 facing the valve body tip surface 22 and including at least the axis C1 is defined as the body bottom surface 112, and the body bottom surface 112 is curved in the same orientation as the orientation in which the valve body tip surface 22 is curved.

In the present embodiment, the curvature radius R112 of the body bottom surface 112 is larger than the curvature radius R22 of the valve body tip surface 22. Therefore, when the valve body separation distance Ha is continuously reduced, it is possible to restrict the valve body separation distance Ha from being suddenly reduced, and it is possible to promote a gradual reduction. Therefore, it is possible to promote that a fuel in the portion of the seat downstream passage Q20 close to the axis C1, that is, the radial inner portion, is easily attracted to the inflow port 11in.

In the present embodiment, in the outer surface of the injection hole body 11, the region including at least the portion between the outflow port 11out and the axis C1 is defined as an outer surface central region 114*a*, and the outer surface central region 114*a* is curved in the same orientation as an orientation in which the valve body tip surface 22 is curved. Under the condition that the center of the curvature radius is present at the same location, the curvature radius of the outer surface central region 114*a* is larger than the curvature radius of the body bottom surface 112. Contrary to this structure, when both curvature radii are the same as each other, the thickness of the injection hole body 11 on the body outer surface 114 becomes thinner as a position thereof becomes distant from the axis C1. In contrast, in the present embodiment, since the outer surface central region 114*a* is curved as described above, it is possible to restrict the thickness of the injection hole body 11 from being uneven.

However, as described above, there is concern that a fuel in the seat downstream passage Q20 flows out of the outflow port 11out due to inertia immediately after the valve is closed, then leaks out of the outflow port 11out by its own weight, and the leaked fuel adheres to the body outer surface 114 and accumulates as a deposit. In response to this concern, when the inflow port gap distance H is reduced and the volume of the seat downstream passage Q20 is reduced, an amount of a fuel to be leaked can be reduced and a leakage amount can be reduced such that deposit accumulation can be restricted.

On the other hand, since a fuel flow direction in the seat upstream passage Q10 and the tapered chamber Q21 and a fuel flow direction in the injection hole 11*a* are greatly different from each other, the fuel flow direction will suddenly change (bend) when the fuel flows from the sack chamber Q22 into the inflow port 11in. When the inflow port gap distance H is reduced in order to reduce the above-described leakage amount, a sudden change (bending) in the flow direction is promoted, and thus an increase in pressure loss is promoted. That is, the inflow port gap distance H being reduced in order to reduce the amount of fuel leakage is contrary to the pressure loss being reduced.

Figure 5:
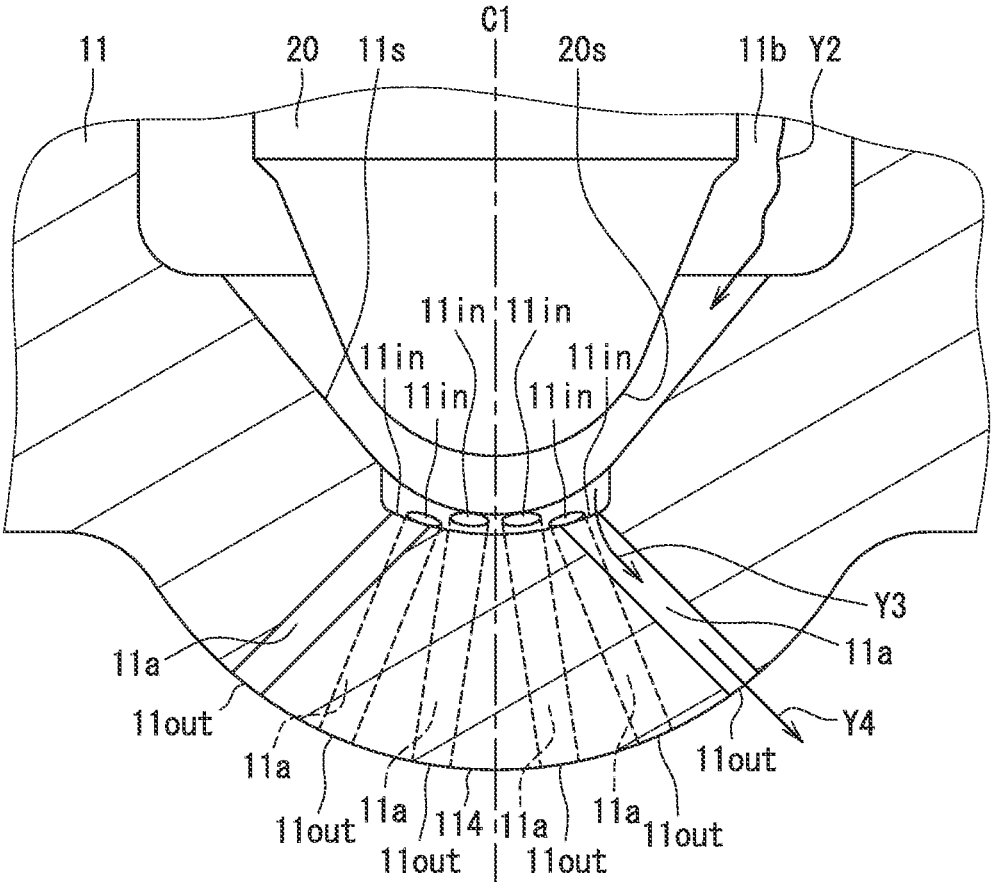
FIG. 5 is an enlarged view of FIG. 2 illustrating a state in which a needle is opened.

Here, the fuel that passes through the seat position R1 and flows into the seat downstream passage Q20 changes in a direction thereof as indicated by the arrow Y3 in FIG. 5 and flows into the inflow port 11in, as described above. The fuel flowing into the seat downstream passage Q20 in this way may be roughly classified into a vertical inflow fuel Y3*a* and a horizontal inflow fuel Y3*b* illustrated in FIG. 6. The vertical inflow fuel Y3*a* is a fuel that flows from the seating surface 11*s* toward the inflow port 11in at the shortest distance. The horizontal inflow fuel Y3*b* is a fuel that flows from the seating surface 11*s* toward the portion (inter-injection hole portion 112*a*) between the inflow ports 11in of the two adjacent injection holes 11*a*, and then changes in an orientation thereof and flows from the inter-injection hole portion 112*a* to the inflow port 11in.

For both the vertical inflow fuel Y3*a* and the horizontal inflow fuel Y3*b*, the pressure loss increases as the inflow port gap distance H is reduced in order to reduce the volume of the seat downstream passage Q20. However, for the horizontal inflow fuel Y3*b*, the increase in pressure loss can be alleviated by reducing the inter-injection hole distance L. Therefore, the increase in the pressure loss due to the reduction of the inflow port gap distance H can be alleviated by reducing the inter-injection hole distance L.

In view of this point, in the present embodiment, since the inter-injection hole distance L is smaller than the inflow port gap distance H, the pressure loss of the horizontal inflow fuel Y3*b* can be alleviated compared with a case where the inter-injection hole distance L is larger than the inflow port gap distance H. Therefore, it is possible to alleviate the increase in the pressure loss due to the reduction of the inflow port gap distance H while reducing the volume of the seat downstream passage Q20 by reducing the inflow port gap distance H. That is, according to the present embodiment, it is possible to achieve both reduction of the fuel leakage amount by reducing the volume of the seat downstream passage Q20 and reduction of the pressure loss caused by reduction of the inter-injection hole distance L.

As the pressure loss is reduced as described above, the flow velocity of the fuel flowing from the sack chamber Q22 into the injection hole 11*a* increases. Thus, it is possible to restrict foreign matter mixed in the fuel from staying in the sack chamber Q22, and thus to improve the foreign matter discharge property from the injection hole 11*a*. A remaining fuel can be reduced by reducing the volume of the seat downstream passage Q20, and the pressure loss can be reduced by reducing the inter-injection hole distance L to improve the discharge property of the remaining fuel.

In the present embodiment, a cylinder obtained by causing a virtual circle that is tangent to portions of the circumferential edges of the respective multiple inflow ports 11in closest to the axis C1 and is centered on the axis C1 to extend straight along the axis C1 direction from the inflow port 11in to the needle 20 is defined as a virtual cylinder. A volume of the space surrounded by the virtual cylinder in the fuel passage 11*b* is defined as the central prism volume V1. A sum of the volumes of the multiple injection holes 11*a* is defined as the total injection hole volume V2. The total injection hole volume V2 is larger than the central prism volume V1.

Thus, a flow rate of the mainstream can be increased compared with a case where the total injection hole volume V2 is smaller than the central prism volume V1, and it is possible to reduce an amount of a fuel that is hardly attracted to the mainstream compared with a case where the total injection hole volume V2 is smaller than the central prism volume V1. Therefore, since it is possible to reduce an amount of a fuel remaining without being able to be vigorously ejected from the injection hole 11*a* at a high flow velocity along with the mainstream, the fuel adhering to the body outer surface 114 or the inner surface of the injection hole 11*a* can be reduced, and thus a deposit can be restricted from accumulating on the body outer surface 114.

In the present embodiment, the total injection hole volume V2 is larger than the central prism volume V1 in a state in which the needle 20 is separated up to the farthest position in a movable range of the needle 20 from the seating surface 11*s*, that is, up to the full lift position. Thus, the flow rate of the mainstream can be increased more than in a case where the total injection hole volume V2 is smaller than the central prism volume V1 in the full lift state, and an amount of a fuel that is hardly attracted to the mainstream can be further reduced to promote the improvement of discharge property of a remaining fuel.

In the present embodiment, the total injection hole volume V2 is larger than the seat downstream volume V3 in the valve closed state. Thus, the flow rate of the mainstream can be further increased more than in a case where the total injection hole volume V2 is smaller than the seat downstream volume V3, and an amount of a fuel that is hardly attracted to the mainstream can be further reduced to promote the improvement of discharge property of a remaining fuel.

In the present embodiment, the total injection hole volume V2 is larger than the seat downstream volume V3 in a state in which the needle 20 is separated up to the farthest position in a movable range of the needle 20 from the seating surface 11*s*, that is, up to the full lift position. Therefore, the flow rate of the mainstream can be further increased more than in a case where the total injection hole volume V2 is smaller than the seat downstream volume V3 in the full lift state, and an amount of a fuel that is hardly attracted to the mainstream can be further reduced to promote the improvement of discharge property of a remaining fuel.

In the present embodiment, the total volume V4 directly above the injection hole, which is a total volume of the volume V4*a* directly above the injection hole, is larger than the central prism volume V1 in a state in which the needle 20 is seated on the seating surface 11*s*, that is, in the valve closed state. Thus, the flow rate of the mainstream can be further increased more than in a case where the total volume V4 directly above the injection hole is smaller than the central prism volume V1 in the valve closed state, and an amount of a fuel that is hardly attracted to the mainstream can be further reduced to promote the improvement of discharge property of a remaining fuel.

In the present embodiment, a sum of the circumferential edge lengths L5*a* of the multiple inflow ports 11in is defined as the total circumferential edge length L5, and a circumferential length of a virtual circle that is tangent to portions of the circumferential edges of the respective multiple inflow ports 11in closest to the axis C1 and is centered on the axis C1 is defined as the virtual circumferential length L6. The total circumferential edge length L5 is longer than the virtual circumferential length L6. Thus, the flow rate of the mainstream can be further increased more than in a case where the total circumferential edge length L5 is shorter than the virtual circumferential length L6, and an amount of a fuel that is hardly attracted to the mainstream can be further reduced to promote the improvement of discharge property of a remaining fuel.

In the present embodiment, the first spring member SP1 that exerts an elastic force that presses the needle 20 against the seating surface 11*s* is provided. The seat angle θ, which is an angle formed between two straight lines appearing on the cross section of the seating surface 11*s* including the axis C1, is 90 degrees or less. Thus, the bounce of the needle 20 to the valve opening side is restricted, and thus the bounce of the needle 20 can be reduced.

In the present embodiment, the multiple injection holes 11*a* are arranged around the axis C1 at equal intervals on a concentric circle when viewed from the axis C1 direction. That is, the inter-injection hole distance L is equal for all the injection holes 11*a*. Thus, since it is promoted that the fuel flows evenly into all the injection holes 11*a*, the pressure loss when the fuel flows from the sack chamber Q22 into the inflow port 11in can be reduced.

In the present embodiment, the surface roughness of the portion of the injection hole body 11 forming the fuel passage 11*b* is coarser than the surface roughness of the portion forming the inner wall surface of the injection hole 11*a*. Therefore, the pressure loss of the fuel flowing in the injection hole 11*a* can be reduced and thus the flow velocity can be increased compared with a case where both of the portions have the same surface roughness. As a result, the fuel present in the portion of the volume V4*a* directly above the injection hole can flow, that is, the mainstream in the sack chamber Q22 can be accelerated, and an action of attracting a fuel around the mainstream to the mainstream can be promoted. Therefore, it is possible to promote the improvement of the discharge property of a remaining fuel such that a fuel in the sack chamber Q22 is vigorously discharged immediately after the valve is closed, and the improvement of the discharge property of foreign matter staying in the sack chamber Q22.

Countermeasures for Injection Amount Variation Due to Three-Stage Throttle

By the way, when the seat surface 20*s* is not pressed against the seating surface 11*s* and is in contact with the seating surface 11*s*, the needle 20 and the injection hole body 11 are in line contact with each other, and a sufficient sealing function cannot be realized. In contrast, when the seat surface 20*s* is pressed against the seating surface 11*s* with a sufficient force, the needle 20 is elastically deformed by the pressing force such that the seat surface 20*s* is expanded, and thus a sufficient sealing function is realized. In view of this point, in the present embodiment, the seat surface 20*s* is curved to be swollen toward the seating surface 11*s*. Thus, an area of the seat surface 20*s* that is expanded due to elastic deformation can be increased, and thus the sealing function can be improved.

A volume of the seat downstream passage Q20 is smaller than in a case where a conical side surface shape is formed unlike the above-described curved shape, that is, an outer line of the cross section including the axis C1 has a tapered shape extending linearly in a direction intersecting the axis C1. Therefore, the leakage amount can be reduced, and thus the accumulation of deposits on the injection hole body 11 can be restricted. However, when the volume of the seat downstream passage Q20 is reduced in this way, there is new concern about a problem of having a three-stage throttle structure described in detail below.

Hereinafter, details of the three-stage throttle and the concern caused by the three-stage throttle will be described with reference to FIGS. 11 to 15.

Figure 11:
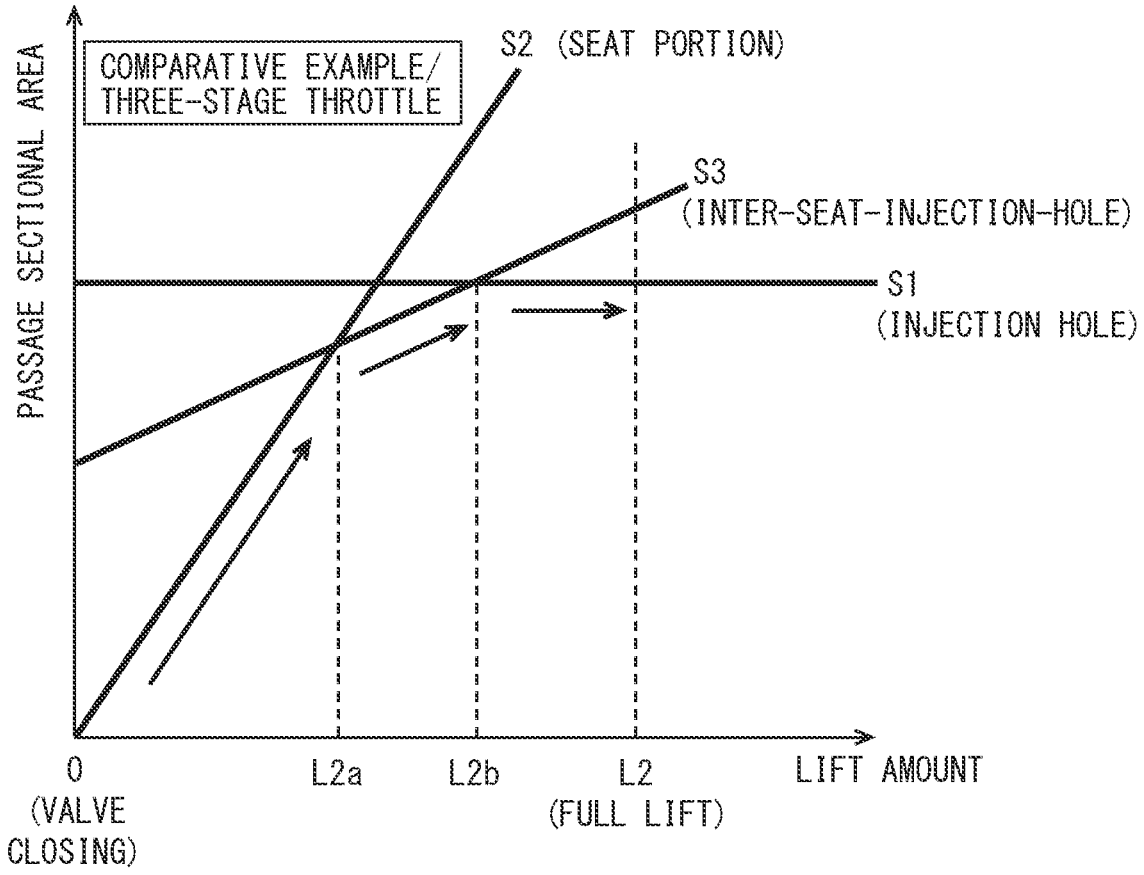
FIG. 11 is a diagram illustrating changes in passage sectional area at each of a seat surface, between the seat surface and the injection hole, and the injection hole when a lift amount increases due to a valve opening operation in a comparative example of the first embodiment.

A horizontal axis in FIG. 11 indicates a lift amount of the needle 20, that is, a lift-up amount from the state illustrated in FIG. 4(*b*). A vertical axis in FIG. 11 indicates a magnitude of a passage sectional area at each portion inside the fuel injection valve 1. The passage sectional area is a sectional area when the passage is cut perpendicularly to a direction in which the passage extends, and is a sectional area when the passage is cut at a position where the sectional area is the minimum.

For example, a passage sectional area of the injection hole 11*a* will be referred to as an injection hole passage sectional area S1 in the following description. The injection hole passage sectional area S1 is defined as an area of the injection hole 11*a* that appears when the injection hole body 11 is cut perpendicularly to the axis C2, and is defined as an area when the injection hole 11*a* is cut at a position in the axis C2 direction where the area is the minimum. When the multiple injection holes 11*a* are provided as in the present embodiment, a value obtained by integrating the passage sectional areas of all the injection holes 11*a* corresponds to the injection hole passage sectional area S1. As illustrated in FIG. 11, the injection hole passage sectional area S1 is constant regardless of a lift position (lift amount) of the needle 20.

For example, a passage sectional area of the portion (seat portion) between the seat surface 20*s* and the seating surface 11*s* of the fuel passage 11*b* in the valve open state will be referred to as a seat portion passage sectional area S2 in the following description. The seat portion passage sectional area S2 is defined as an area of a conical outer circumferential surface formed by causing a virtual line HT1 (refer to FIG. 7) that connects the seat position R1 on the seat surface 20*s* to the seating surface 11*s* at the shortest distance to extend in an annular shape around the axis C1. As illustrated in FIG. 11, the seat portion passage sectional area S2 increases as the lift amount of the needle 20 increases.

For example, a passage sectional area of a portion of the fuel passage 11*b* in the valve open state on the downstream side of the seat position R1, specifically, the tapered surface 111 and a portion on the downstream side of the tapered surface 111, will be referred to as an inter-seat-injection-hole passage sectional area S3. The inter-seat-injection-hole passage sectional area S3 is defined as a smaller area of a connecting surface passage sectional area S3*b* which is a passage sectional area on the connecting surface 113 and a body bottom surface passage sectional area S3*a* which is a passage sectional area on the body bottom surface 112.

The connecting surface passage sectional area S3*b* is defined as an area of a conical outer circumferential surface formed by causing a virtual line HT2 (refer to FIG. 7) that connects the connecting surface 113 to the seating surface 11*s* at the shortest distance to extend in an annular shape around the axis C1. The body bottom surface passage sectional area S3*a* is defined as an area of a conical outer circumferential surface formed by causing a virtual line HT3 (refer to FIG. 7) that connects the body bottom surface 112 to the seating surface 11*s* at the shortest distance to extend in an annular shape around the axis C1.

As illustrated in FIG. 7, the virtual line HT1 related to the seat portion passage sectional area S2 is shorter than the virtual line HT2 related to the connecting surface passage sectional area S3*b*. The virtual line HT2 related to the connecting surface passage sectional area S3*b* is shorter than the virtual line HT3 related to the body bottom surface passage sectional area S3*a*. A radius of the conical outer circumferential surface related to the seat portion passage sectional area S2, that is, a distance between the seat position R1 and the axis C1 is larger than a radius of the conical outer circumferential surface related to the connecting surface passage sectional area S3*b*. A radius of the conical outer circumferential surface related to the connecting surface passage sectional area S3*b* is larger than a radius of the conical outer circumferential surface related to the body bottom surface passage sectional area S3*a*.

As described above, the longer the virtual line (generatrix), the shorter the radius of each conical outer circumferential surface. An amount by which the area of the conical outer circumferential surface increases due to lift-up, that is, a slope of the solid line in FIG. 11 becomes larger as the conical outer circumferential surface has a larger radius. Therefore, as the area of the conical outer circumferential surface is reduced when the valve is closed, an area increase amount due to lift-up becomes larger. Specifically, as illustrated in FIG. 11, a value of closing the inter-seat-injection-hole passage sectional area S3 at the time of valve closing is larger than a value (zero) of the seat portion passage sectional area S2 at the time of valve closing. An increase amount of the inter-seat-injection-hole passage sectional area S3 due to lift-up is smaller than an increase amount of the seat portion passage sectional area S2.

A flow rate of a fuel injected from the injection hole 11*a*, which is an amount (injection rate) injected per unit time, is specified according to the minimum passage sectional area in the passage including the injection hole 11*a*, a pressure of a fuel supplied to the fuel injection valve 1, fuel properties, or the like. The fuel properties are, for example, the viscosity and specific gravity of the fuel. The minimum passage sectional area is the minimum value among the injection hole passage sectional area S1, the seat portion passage sectional area S2, and the inter-seat-injection-hole passage sectional area S3. Since the seat portion passage sectional area S2 and the inter-seat-injection-hole passage sectional area S3 change due to the lift-up, the minimum passage sectional area also changes, and, as a result, the injection rate also changes.

In short, a flow rate of a fuel supplied to the fuel injection valve 1 is throttled at a portion having the minimum passage sectional area up to the outflow port 11out of the injection hole 11*a*. In the following description, a state in which a flow rate (injection rate) of a fuel injected from the outflow port 11out is restricted to a flow rate throttled by the gap (seat portion) between the seat surface 20*s* and the seating surface 11*s* is defined as a seat portion throttle state. A state in which the flow rate is restricted to the flow rate throttled by the injection hole 11*a* is defined as an injection hole throttle state. A state in which the flow rate is restricted to a flow rate throttled by an inter-seat-injection-hole gap that is a portion of the fuel passage 11*b* on the downstream side of the seating surface 11*s* is defined as an inter-seat-injection-hole throttle state.

As the wear of the seat surface 20*s* progresses, the seat position R1 moves to the downstream side. Therefore, it is considered that the entire tapered surface 111 can be the seating surface 11*s*, and the tapered surface 111 is excluded from the above-described "portion of the fuel passage 11*b* on the downstream side of the seating surface 11*s*". That is, the above-described "inter-seat-injection-hole gap" corresponds to the sack chamber Q22.

FIG. 11 illustrates a change in a passage sectional area of a fuel injection valve as a comparative example with respect to the present embodiment. In this comparative example, when the needle 20 is operated to be opened from the valve closing position to the full lift position, the throttle portion changes in the following three stages according to a lift position.

First, in the first stage, the seat portion throttle state is brought in a lift region from the valve closing position to the first intermediate position (lift amount=L2*a*). In the next second stage, the inter-seat-injection-hole throttle state is brought in a lift region from a first intermediate position L2*a* to a second intermediate position (lift amount=L2*b*). In the next third stage, the injection hole throttle state is brought in a lift region from the second intermediate position to the full lift position (lift amount=L2).

Here, an instrumental error variation in a shape or a size of each portion of the needle 20 or the injection hole body 11 is reflected in an instrumental error variation in an injection amount with respect to the energization time, which hinders the control of an injection amount with high accuracy. In a case of a structure in which the throttle portion changes in three stages, a variation in the injection amount due to the variation in the shape and the size becomes large, and thus the instrumental error variation in the injection amount becomes large.

Figure 12:
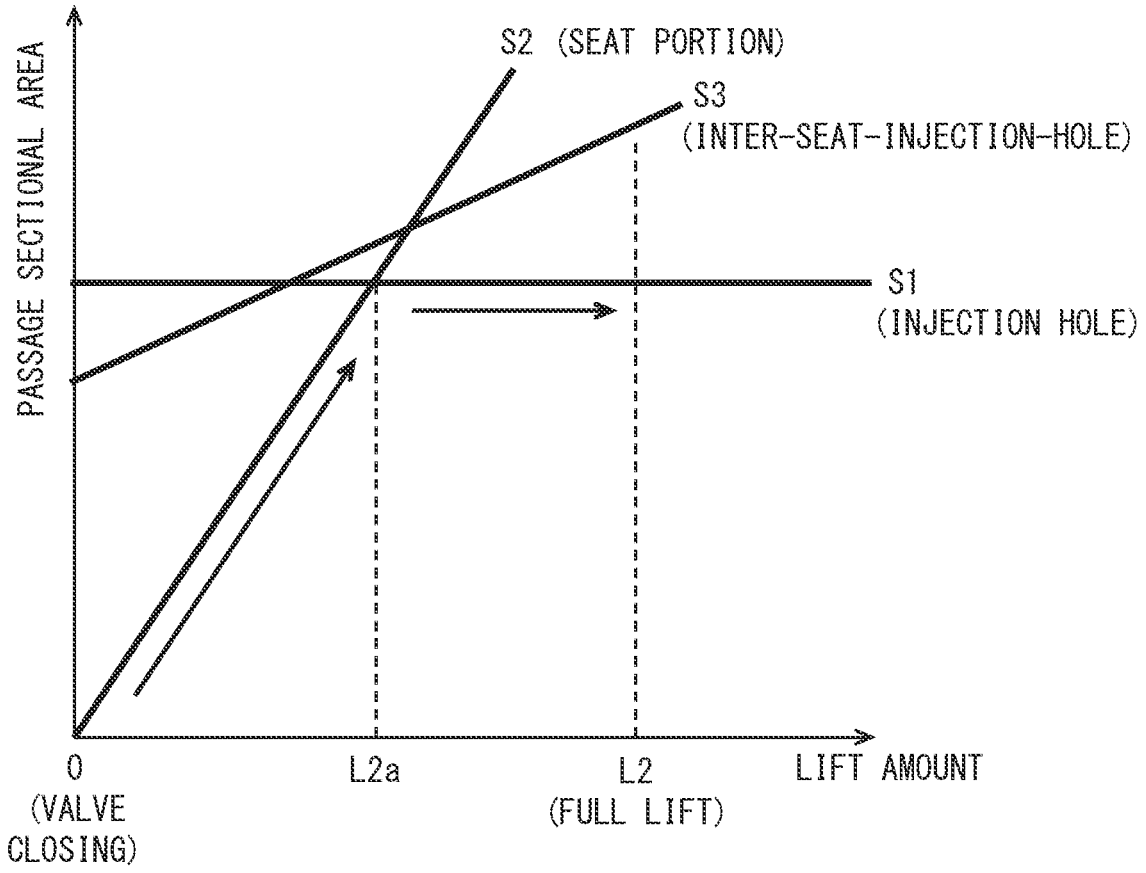
FIG. 12 is a diagram illustrating changes in the passage sectional area at each of the seat surface, between the seat surface and the injection hole, and the injection hole when the lift amount increases due to the valve opening operation in the first embodiment.

In consideration of this point, as illustrated in FIG. 12, the fuel injection valve 1 according to the first aspect is configured to be brought into the seat portion throttle state from the valve closing position to the intermediate position (lift amount=L2*a*), and be brought into the injection hole throttle state from the intermediate position to the full lift position. That is, the throttle portion changes in two stages of the seat portion throttle state and the injection hole throttle state.

Hereinafter, methods for realizing the two-stage throttle will be described with reference to FIGS. 13 to 15.

Figure 13:
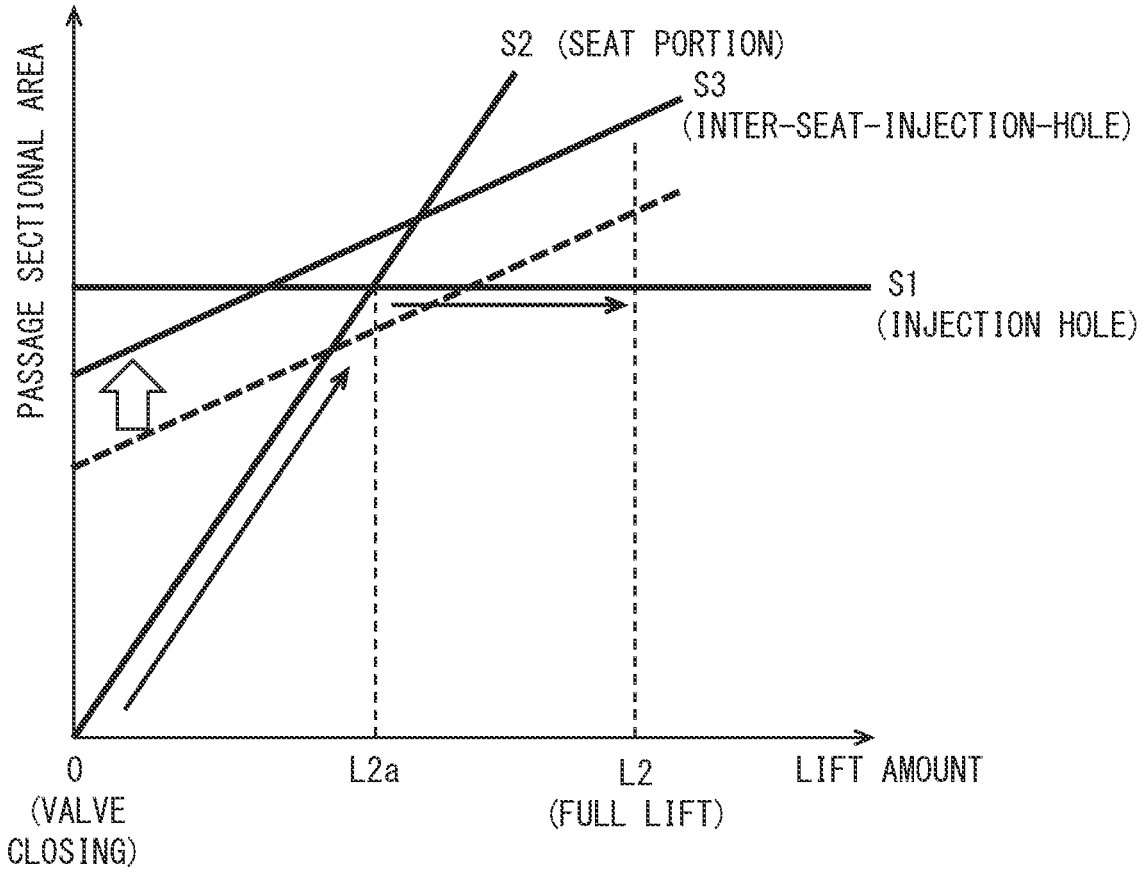
FIG. 13 is a diagram illustrating that a throttle portion changes in two stages by increasing a passage sectional area between the seat surface and the injection hole when the valve is closed in the first embodiment.

A first method illustrated in FIG. 13 is a method of increasing the inter-seat-injection-hole passage sectional area S3 at the time of valve closing from a dotted line position to a solid line position in the figure. For example, the valve body separation distance Ha may be increased such that the sack chamber Q22 is expanded in the axis C1 direction. Specifically, the curvature radius R22 of the valve body tip surface 22 may be increased, the curvature radius R112 of the body bottom surface 112 may be decreased, or a tilt of the connecting surface 113 may be steep.

Figure 14:
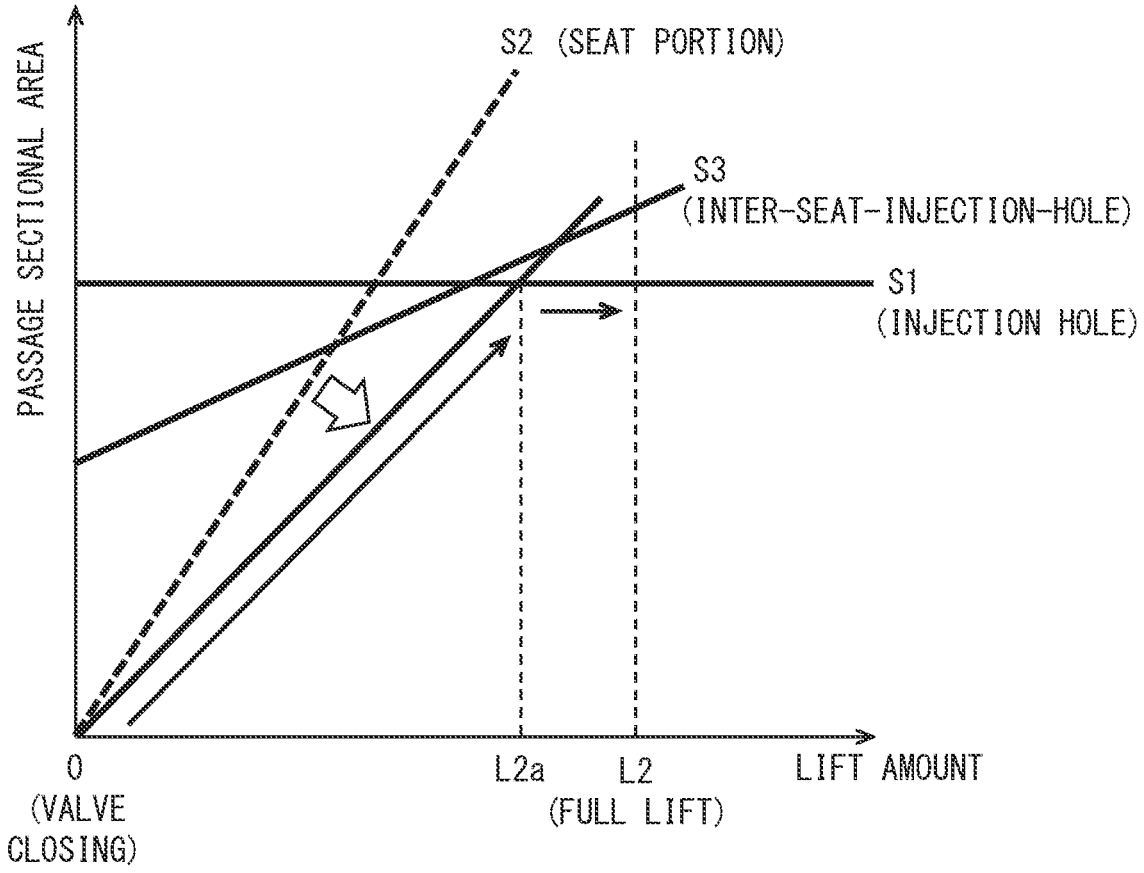
FIG. 14 is a diagram illustrating that the throttle portion changes in two stages by reducing a slope in which the passage sectional area of a seat portion increases due to lift-up in the first embodiment.

A second method illustrated in FIG. 14 is a method of reducing an increase speed (slope) of the seat portion passage sectional area S2 due to lift-up. For example, by moving the seat position R1 closer to the axis C1, a diameter of the conical outer circumferential surface with the virtual line HT1 as the generatrix may be reduced, and the dotted line position in the figure may be changed to the solid line position.

Figure 15:
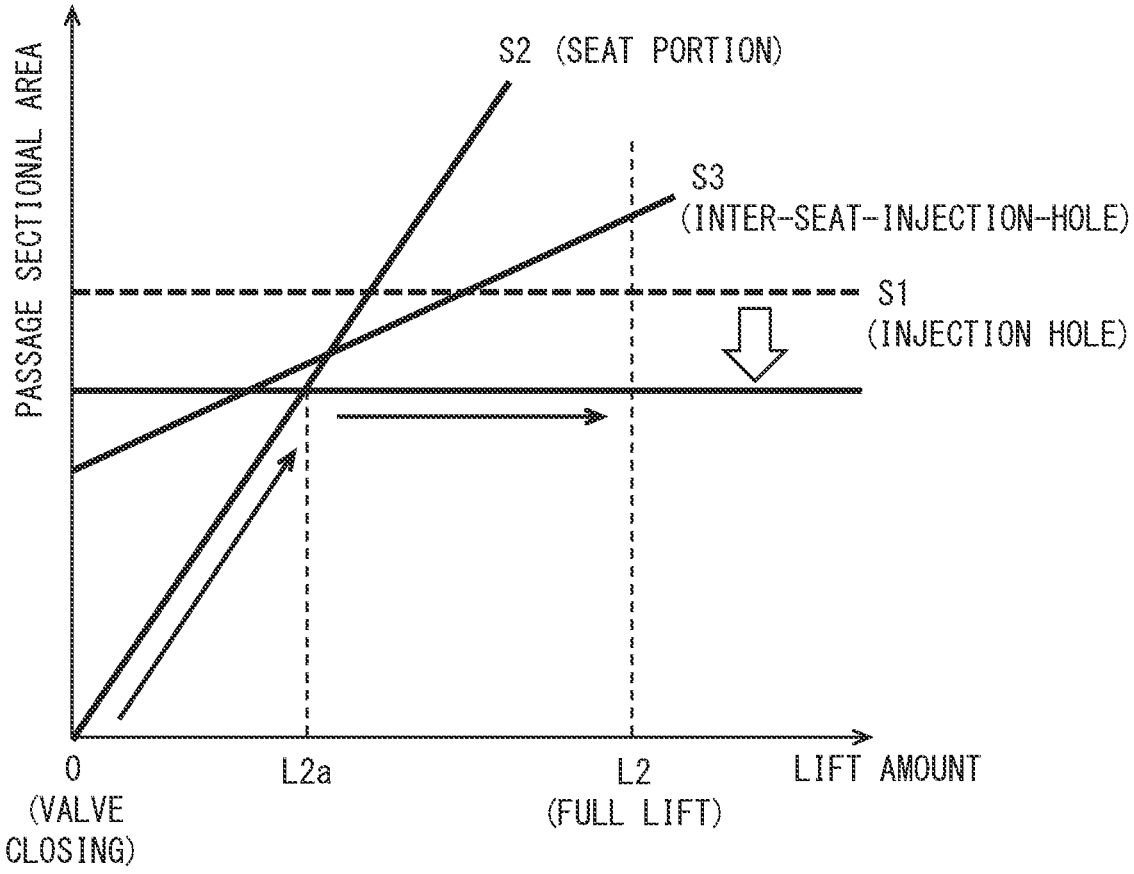
FIG. 15 is a diagram illustrating that a throttle portion changes in two stages by reducing a passage sectional area of the injection hole in the first embodiment.

A third method illustrated in FIG. 15 is a method of reducing the injection hole passage sectional area S1. For example, the dotted line position in the figure may be changed to the solid line position by reducing the number of the injection holes 11*a* or reducing the diameter of the injection holes 11*a*.

As described above, according to the present embodiment, since the throttle portion changes in two stages, an instrumental error variation in the injection amount with respect to the energization time can be reduced compared with a case where the throttle portion changes in three stages as described above.

In the present embodiment, as illustrated in FIGS. 13 to 15, the inter-seat-injection-hole passage sectional area S3 is smaller than the injection hole passage sectional area S1 in the valve closed state. This indicates that the volume of the sack chamber Q22 at the time of valve closing is smaller than that in a case where the inter-seat-injection-hole passage sectional area S3 is larger than the injection hole passage sectional area S1. Therefore, the above-described effect of reducing a leakage amount is promoted. The seat portion throttle state is shifted to the injection hole throttle state without being shifted to the inter-seat-injection-hole throttle state, and thus the throttle in two stages is realized.

In the present embodiment, the injection hole body 11 has the tapered surface 111 and the body bottom surface 112. The tapered surface 111 is a surface, including the seating surface 11*s*, formed in a linear shape in a cross section of the needle 20 including the axis C1. The body bottom surface 112 is a surface, including the inflow port 11in, formed in a shape recessed from the tapered surface 111. According to this, the volume of the seat downstream passage Q20 is smaller than that in a case where the body bottom surface 112 is not formed in a shape recessed from the tapered surface 111. Therefore, the above-described effect of reducing a leakage amount is promoted, and the seat portion throttle state is shifted to the injection hole throttle state without being shifted to the inter-seat-injection-hole throttle state, and thus the throttle in two stages is realized.

Second Embodiment

Figure 16:
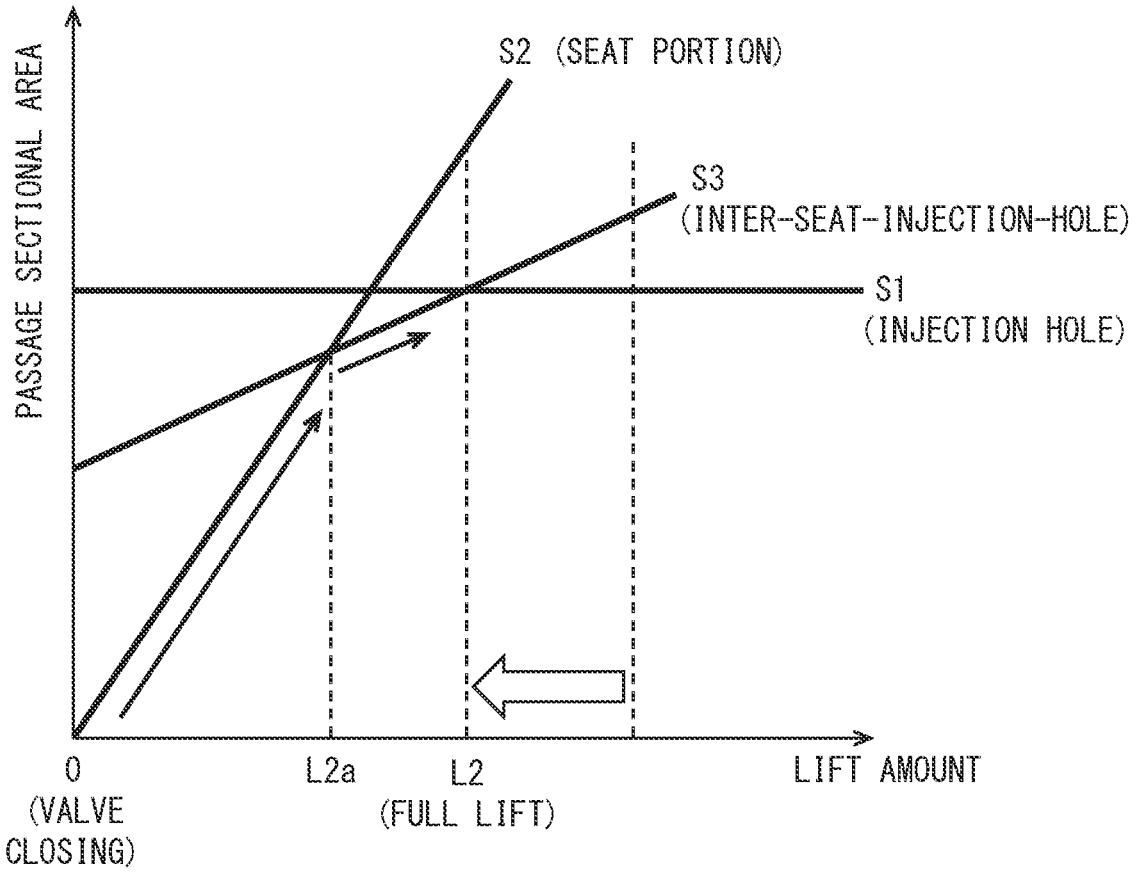
FIG. 16 is a diagram illustrating that a throttle portion changes in two stages by reducing a lift amount at a full lift position in a second embodiment.

In the first embodiment, in order to realize a structure in which the throttle portion changes in two stages, the seat portion throttle state is shifted to the injection hole throttle state. In contrast, in the present embodiment, the seat portion throttle state is shifted to the inter-seat-injection-hole throttle. For example, as illustrated in FIG. 16, the seat portion throttle state may be shifted to the inter-seat-injection-hole throttle and then may not be shifted to the injection hole throttle state by reducing the lift amount at the full lift position, and thus two-stage throttle may be realized.

Other configurations in the present embodiment are the same as those in the first embodiment. For example, the inter-seat-injection-hole passage sectional area S3 is set to be smaller than the injection hole passage sectional area S1 in the valve closed state.

Even with the two-stage throttle structure according to the present embodiment, in the same manner as in the first embodiment, it is possible to achieve an effect of reducing an instrumental error variation in an injection amount with respect to the energization time compared with a case of the three-stage throttle structure.

Third Embodiment

Figure 17:
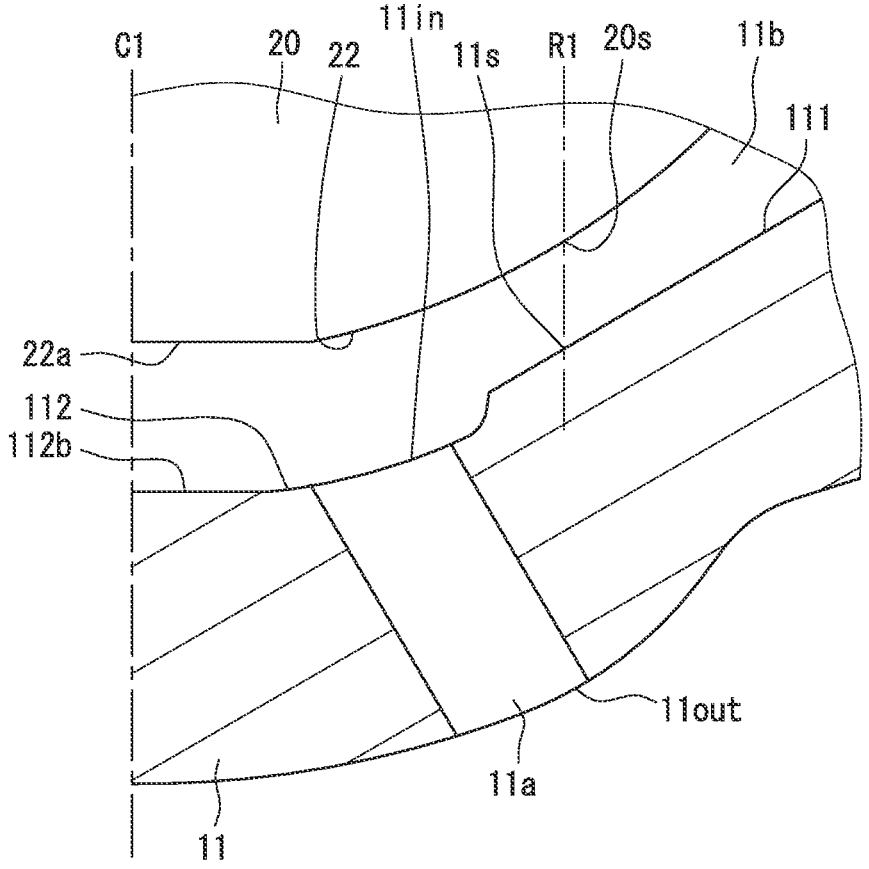
FIG. 17 is a sectional view illustrating a state in which a needle is opened in a third embodiment.

In the first embodiment, the entire valve body tip surface 22 is curved such that the valve body tip surface 22 is curved to be swollen toward the body bottom surface 112. In contrast, in the present embodiment, as illustrated in FIG. 17, a flat surface 22*a* extending perpendicularly to the axis C1 direction is provided at the tip of the needle 20 located on the downstream side of the seat surface 20*s*. The portion other than the flat surface 22*a* is curved in the same manner as in the first embodiment.

In the first embodiment, the entire body bottom surface 112 is curved such that the body bottom surface 112 is curved in an orientation away from the valve body tip surface 22. In contrast, in the present embodiment, as illustrated in FIG. 17, a flat surface 112*b* extending perpendicularly to the axis C1 direction is provided at the center of the body bottom surface 112 located closer to the axis C1 than the injection hole 11*a*. A portion other than the flat surface 112*b* is curved in the same manner as in the first embodiment.

According to this, the volume of the sack chamber Q22 at the time of valve closing is smaller than that in a case of the overall curvature in which the flat surface 22*a* is not provided on the valve body tip surface 22. Similarly, the volume of the sack chamber Q22 at the time of valve closing is smaller than that in a case of the overall curvature in which the flat surface 112*b* is not provided on the body bottom surface 112. Therefore, the above-described effect of reducing a leakage amount is promoted, and the seat portion throttle state is shifted to the injection hole throttle state without being shifted to the inter-seat-injection-hole throttle state, and thus the throttle in two stages is realized.

Fourth Embodiment

Figure 18:
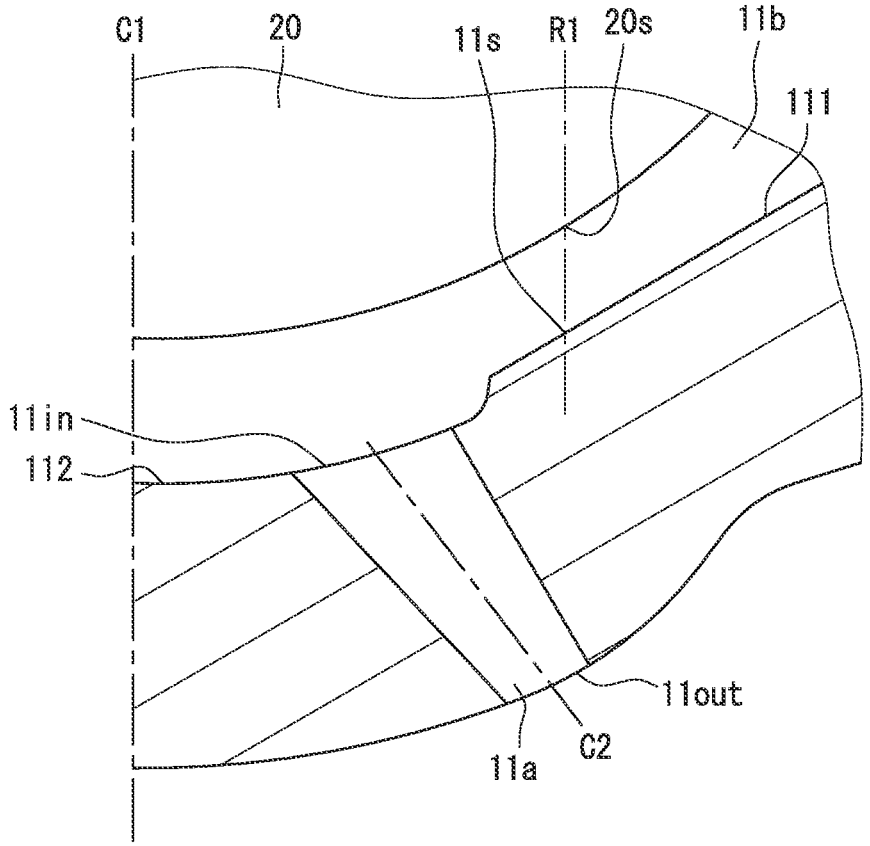
FIG. 18 is a sectional view of an injection hole body and a needle according to a fourth embodiment, and is a diagram for describing a shape of the injection hole.

The injection hole 11*a* according to the first embodiment has a straight shape of which a passage sectional area is uniform from the inflow port 11in to the outflow port 11out. The passage sectional area is an area of the injection hole 11*a* in the direction perpendicular to an axis C2. The axis C2 is a line connecting the center of the inflow port 11in to the center of the outflow port 11out. In contrast, in the present embodiment, as illustrated in FIG. 18, a shape of the injection hole 11*a* in the cross section including the axis C2 is a tapered shape of which a diameter gradually decreases from the inflow port 11in to the outflow port 11out, and an opening area of the inflow port 11in is larger than an opening area of the outflow port 11out.

As described above, in the present embodiment, the opening area of the inflow port 11in is larger than the opening area of the outflow port 11out. Therefore, a fuel in the sack chamber Q22 is promoted to flow into the inflow port 11in immediately after the valve is closed compared with a case of the straight shape. Therefore, the above-described discharge property of a remaining fuel can be improved. Since the opening area of the inflow port 11in is larger than the opening area of the outflow port 11out, the above-described penetration force can be increased.

According to the present embodiment, the two-stage throttle structure illustrated in FIGS. 12 and 16 can be achieved by adjusting a taper angle of the injection hole 11*a*. In the present embodiment, a passage sectional area of the outflow port 11out or a portion in the vicinity thereof corresponds to the injection hole passage sectional area S1 that contributes to the injection hole throttle.

Fifth Embodiment

Figure 19:
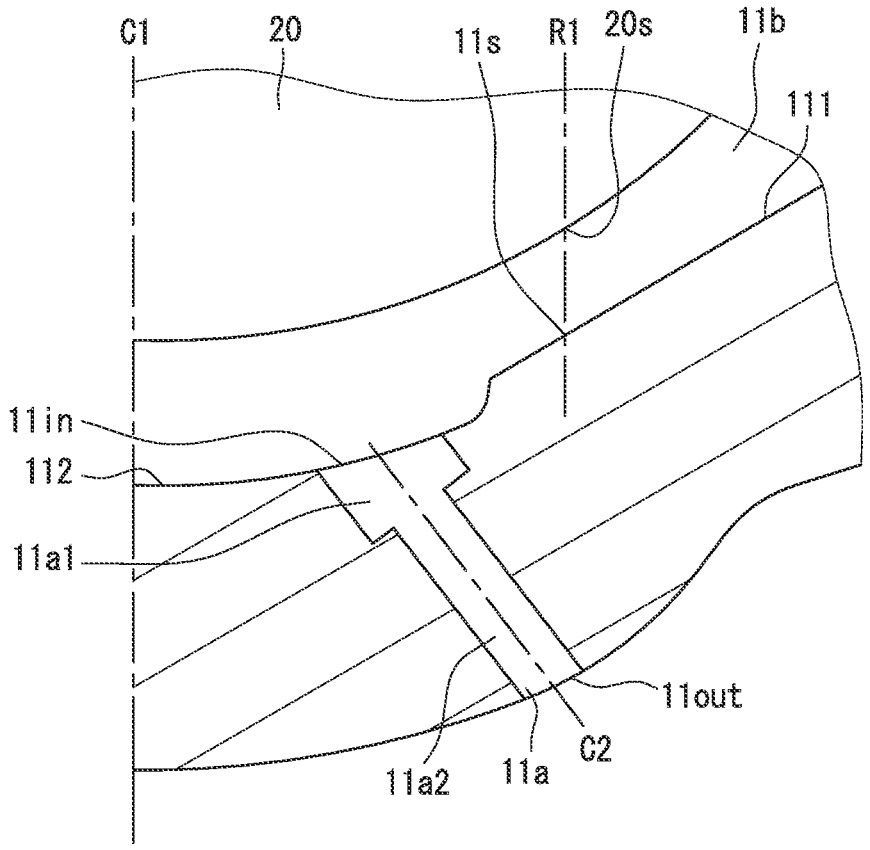
FIG. 19 is a sectional view of an injection hole body and a needle according to a fifth embodiment, and is a diagram for describing a shape of the injection hole.

In the present embodiment, as illustrated in FIG. 19, a shape of the injection hole 11*a* in a cross section including an axis C2 is a stepped shape having an injection hole upstream portion 11*a*1 which is a portion having a large passage sectional area and an injection hole downstream portion 11*a*2 which is a portion having a small passage sectional area. The passage sectional area is an area of the injection hole 11*a* in the direction perpendicular to the axis C2, and the axis C2 is a line connecting the center of the inflow port 11in to the center of the outflow port 11out. The injection hole upstream portion 11*a*1 and the injection hole downstream portion 11*a*2 have a straight shape extending in the axis C2 direction with a constant diameter, and a diameter of the injection hole upstream portion 11*a*1 is larger than a diameter of the injection hole downstream portion 11*a*2. Therefore, the opening area of the inflow port 11in is larger than the opening area of the outflow port 11out.

As described above, also in the present embodiment, the opening area of the inflow port 11in is larger than the opening area of the outflow port 11out in the same manner as in the fourth embodiment, and thus it is possible to improve the discharge property of a remaining fuel and to increase the penetration force.

According to the present embodiment, the two-stage throttle structure illustrated in FIGS. 12 and 16 can be achieved by adjusting a shape of the injection hole downstream portion 11*a*2. In the present embodiment, the passage sectional area of the injection hole downstream portion 11*a*2 corresponds to the injection hole passage sectional area S1 that contributes to the injection hole throttle.

Sixth Embodiment

Figure 20:
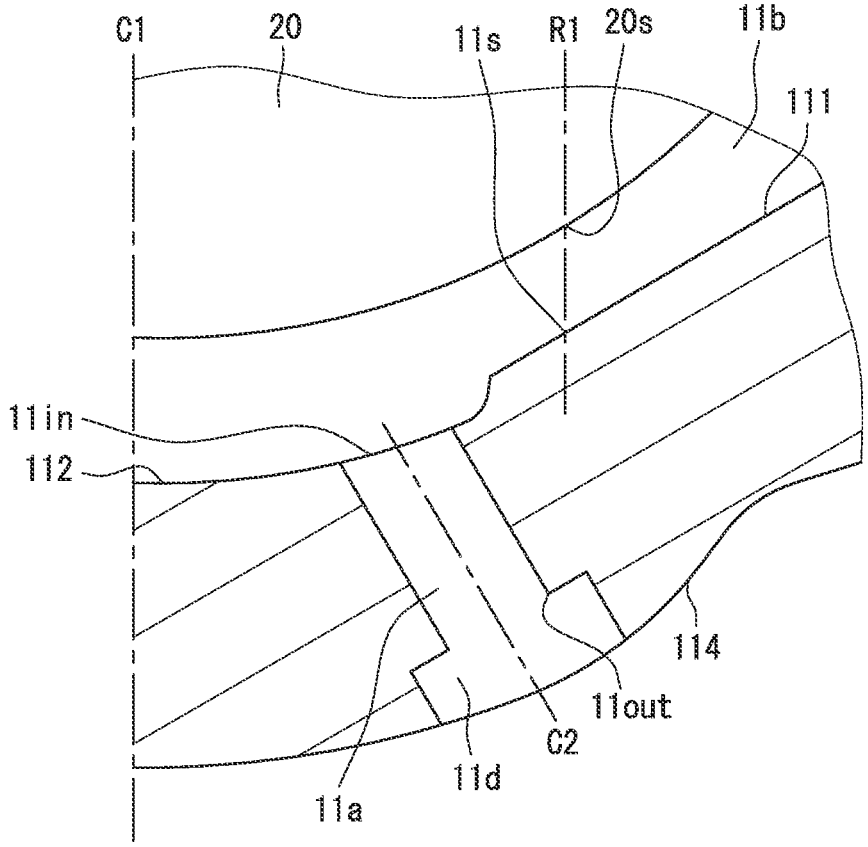
FIG. 20 is a sectional view of an injection hole body and a needle according to a sixth embodiment, and is a diagram for describing a shape of the injection hole.

In the present embodiment illustrated in FIG. 20, a recess 11*d* is provided on the body outer surface 114. The recess 11*d* is circular when viewed from the axis C2 direction, and a diameter of the recess 11*d* is larger than a diameter of the outflow port 11out so as to include the outflow port 11out therein. The circular center of the recess 11*d* coincides with the axis C2 of the injection hole 11*a*. The recess 11*d* is provided in this way, and thus a length of the injection hole 11*a* is reduced, and the penetration force of a fuel injected from the outflow port 11out is reduced. It is possible to suppress a reduction in a thickness dimension in a portion of the injection hole body 11 other than the injection hole 11*a*, and thus to suppress a significant decrease in the strength of the injection hole body 11.

In a case of the structure illustrated in FIG. 20, similarly to each of the above embodiments, the volume V2*a* of the injection hole 11*a* is a volume from the inflow port 11in to the outflow port 11out, and a volume of the recess 11*d* is not included in the volume V2*a* of the injection hole 11*a*. A fuel present in the recess 11*d* is in a pressure-released state, and a portion where the fuel in the pressure-released state is present is not considered to be a part of the injection hole 11*a*. The total injection hole volume V2 is larger than the central prism volume V1 in the seated state.

In the structure including the recess 11*d* illustrated in FIG. 20, a shape of the injection hole 11*a* may be the straight shape illustrated in FIG. 7, may be the tapered shape illustrated in FIG. 18, and may be a reverse tapered shape in which an orientation of the taper is reversed to the orientation in FIG. 18.

Seventh Embodiment

The fuel injection valve 1 according to the first embodiment includes the movable core 30 having one core facing surface 31*c* (refer to FIG. 3). Due to this configuration, a magnetic flux (incoming magnetic flux) entering the movable core 30 and a magnetic flux (outgoing magnetic flux) leaving the movable core 30 are in different orientations (refer to the dotted arrow in FIG. 3). That is, whereas one of the incoming and outgoing magnetic fluxes is a magnetic flux that enters and leaves the movable core 30 in the axis C1 direction to exert a valve opening force on the movable core 30, the other of the incoming and outgoing magnetic fluxes is a magnetic flux that enters and leaves the movable core 30 in the radial direction of the movable core 30 not to contribute to the valve opening force.

Figure 21:
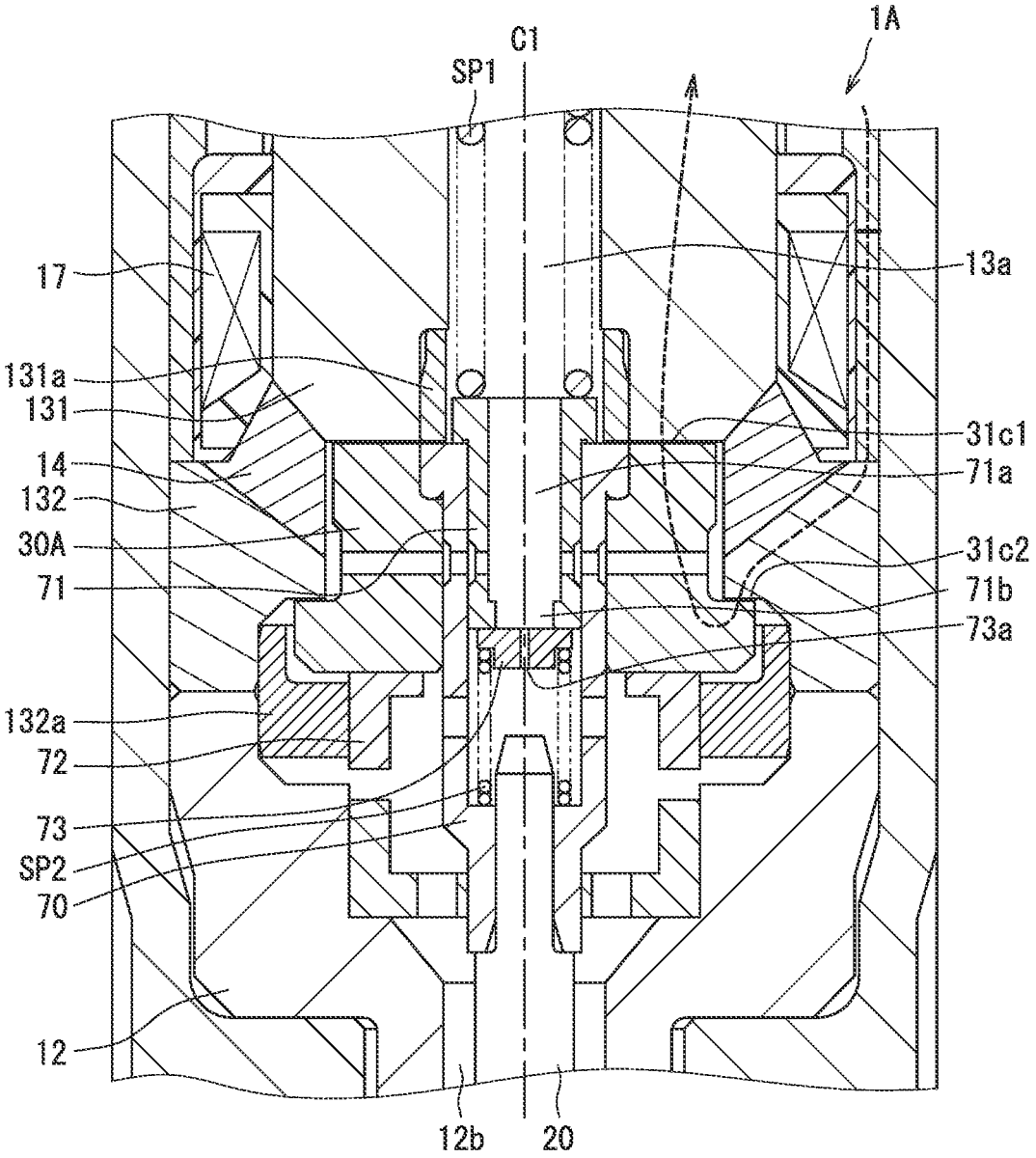
FIG. 21 is a sectional view of a fuel injection valve according to a seventh embodiment.

In contrast, a fuel injection valve 1A of the present embodiment illustrated in FIG. 21 includes a movable core 30A having two core facing surfaces, that is, a first core facing surface 31*c*1 and a second core facing surface 31*c*2. The fuel injection valve 1A includes a first fixed core 131 having a suction surface facing the first core facing surface 31*c*1 and a second fixed core 132 having a suction surface facing the second core facing surface 31*c*2. The non-magnetic member 14 is disposed between the first fixed core 131 and the second fixed core 132. With this configuration, both the incoming and outgoing magnetic fluxes become magnetic fluxes that enter and leave the movable core 30A in the axis C1 direction to exert a valve opening force on the movable core 30A (refer to a dotted arrow in FIG. 21). The movable core 30A and the needle 20 are connected via a connecting member 70, and an orifice member 71 is attached to the connecting member 70.

When the coil 17 is energized to operate the needle 20 to be opened, the movable core 30A is sucked to the fixed cores 131 and 132 by both the first core facing surface 31*c*1 and the second core facing surface 31*c*2. Consequently, the needle 20 is operated to be opened together with the movable core 30A, the connecting member 70, and the orifice member 71. At the full lift position of the needle 20, the connecting member 70 comes into contact with the stopper 131*a* fixed to the first fixed core 131, and the first core facing surface 31*c*1 and the second core facing surface 31*c*2 do not come into contact with the fixed cores 131 and 132.

When the energization of the coil 17 is stopped in order to close the needle 20, an elastic force of the second spring member SP2 applied to the movable core 30 is applied to the orifice member 71. Consequently, the needle 20 is operated to be closed together with the movable core 30A, the connecting member 70, and the orifice member 71.

A sliding member 72 is attached to the movable core 30A and is operated to be opened and closed together with the movable core 30A. The sliding member 72 slides in the axis C1 direction with respect to a cover 132*a* fixed to the second fixed core 132. In summary, it can be said that the needle 20 operated to be opened and closed together with the movable core 30A, the sliding member 72, the connecting member 70, and the orifice member 71 is radially supported by the sliding member 72.

A fuel that has flowed into a flow path 13*a* provided inside the fixed core 13 flows through an internal passage 71*a* of the orifice member 71, an orifice 71*b* provided in the orifice member 71, and an orifice 73*a* provided in the moving member 73 in this order, and then flows into a flow path 12*b*. A moving member 73 is a member that is moved in the axis C1 direction to open and close the orifice 71*b*, and the degree of throttle of a flow path between the flow path 13*a* and the flow path 12*b* is changed by the moving member 73 opening and closing the orifice 71*b*.

The fuel injection valve 1A according to the present embodiment also has the two-stage throttle structure, and can thus restrict an instrumental error variation in an injection amount with respect to the energization time.

Eighth Embodiment

Figure 22:
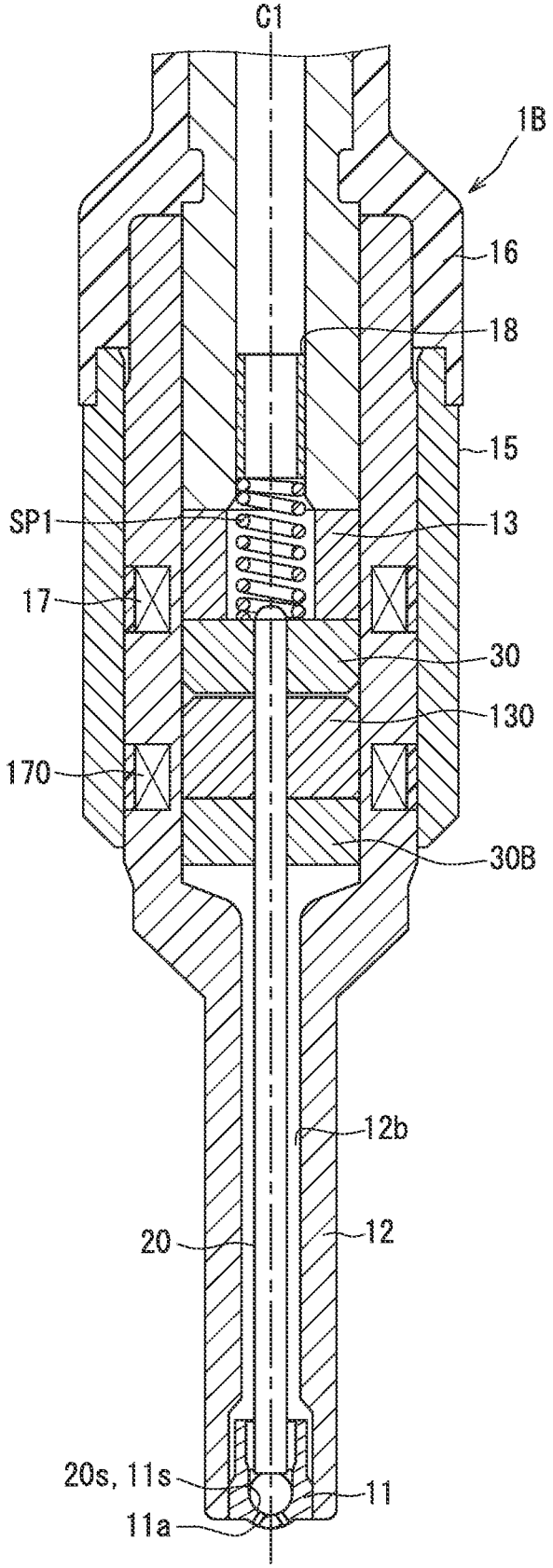
FIG. 22 is a sectional view of a fuel injection valve according to an eighth embodiment.

The fuel injection valve 1 according to the first embodiment includes a single actuator having the coil 17, the fixed core 13, and the movable core 30, and the actuator exerts a valve closing force on the needle 20. In contrast, a fuel injection valve 1B of the present embodiment illustrated in FIG. 22 includes two actuators that exert a valve closing force on the needle 20. That is, in addition to the same coil 17, fixed core 13 and movable core 30 as in the first embodiment, a second coil 170, a fixed core 130, and a movable core 30B are provided.

Specifically, the fixed cores 13 and 130 and the coils 17 and 170 are fixed at different positions on the main body 12 in the axis C1 direction. The two movable cores 30 and 30B are disposed side by side in the axis C1 direction at positions facing the suction surfaces of the fixed cores 13 and 130, respectively. The movable cores 30 and 30B are fixed to the needle 20 and slidably disposed in the main body 12 in the axis C1 direction.

When the needle 20 is operated to be opened, the two coils 17 and 170 are energized and the two movable cores 30 and 30B are sucked to the fixed cores 13 and 130. Consequently, the needle 20 fixed to the movable cores 30 and 30B is operated to be opened against the elastic force of the first spring member SP1. When the needle 20 is operated to be closed, the energization of the two coils 17 and 170 is stopped, and the needle 20 is operated to be closed by the elastic force of the first spring member SP1 applied to the movable core 30.

The fuel injection valve 1B according to the present embodiment also has the two-stage throttle structure, and can thus restrict an instrumental error variation in an injection amount with respect to the energization time.

Other Embodiments

Although the multiple embodiments of the present disclosure have been described above, in addition to a combination of the configurations disclosed in the description of the respective embodiments, configurations in multiple embodiments may be partially combined even when the configurations are not disclosed as long as there is no problem in the combination. An undisclosed combination of the configurations described in the multiple embodiments and modifications is also assumed to be disclosed by the following description.

In each of the above embodiments, the inter-seat-injection-hole passage sectional area S3 is set to be smaller than the injection hole passage sectional area S1 in the valve closed state, but the inter-seat-injection-hole passage sectional area S3 may be set to be larger than the injection hole passage sectional area S1 in the valve closed state.

In the first embodiment, all of the multiple injection holes 11*a* have the same shape. In contrast, the fuel injection valve may be provided with multiple types of injection holes 11*a* having different sizes. In the first embodiment, all of the multiple injection holes 11*a* are disposed on the same inflow center virtual circle R2. In contrast, the fuel injection valve may be provided with respective injection holes 11*a* that are disposed on virtual circles having different sizes.

In the example illustrated in FIG. 12, the front-stage lift amount, which is a lift amount from the valve closing position to the first intermediate position L2*a*, and the rear-stage lift amount, which is a lift amount from the first intermediate position L2*a* to the full lift position, are the same as each other. In contrast, the front-stage lift amount may be smaller than the rear-stage lift amount, or the front-stage lift amount may be larger than the rear-stage lift amount.

In the first embodiment, the inflow port gap distance H is defined as a gap distance at the inflow port center point A. In contrast, the inflow port gap distance H may be defined as a gap distance at a position farthest from the axis C1 in the circumferential edge of the inflow port 11in, or may be defined as a gap distance at a position closest to the axis C1 in the circumferential edge of the inflow port 11in. The inflow port gap distance H may be defined as a gap distance at a position intersecting the inflow center virtual circle R2 in the circumferential edge of the inflow port 11in.

In the first embodiment, when the inter-injection hole distance L and the inflow port gap distance H of each of the multiple injection holes 11*a* are the same, the inter-injection hole distance L is set to be smaller than the inflow port gap distance H. In contrast, when there are different inter-injection hole distances and inflow port gap distances, at least one inter-injection hole distance may be set to be smaller than at least one inflow port gap distance. Alternatively, a distance between the two adjacent injection holes 11*a* may be set to be smaller than the inflow port gap distance of either of the two injection holes 11*a*.

In the first embodiment, the inflow port gap distance H, which is a size of the gap between the outer surface of the needle 20 and the inflow port 11in, is a separation distance from the needle 20 at the center point A of the inflow port 11in. In contrast, the inflow port gap distance H may be a separation distance from the needle 20 at a portion of the injection hole 11*a* other than the center point A. For example, the inflow port gap distance H may be a separation distance in the axis C1 direction at a position farthest from the needle 20 in the injection hole 11*a*, or may be a separation distance in the axis C1 direction at a closest position thereto.

In the first embodiment, the fuel injection valve 1 is of a center-disposed type of being attached to a portion of the cylinder head located at the center of the combustion chamber 2 and injecting a fuel from above the combustion chamber 2 in the direction of the center line of the piston. In contrast, the fuel injection valve may be of a side-disposed type of being attached to a portion of the cylinder block located on the side of the combustion chamber 2 and injecting a fuel from the side of the combustion chamber 2.

In the first embodiment, the movable portion M is supported in the radial direction at two locations such as the portion (needle tip portion) of the needle 20 facing the inner wall surface 11*c* of the injection hole body 11 and the outer circumferential surface 51*d* of the cup 50. In the seventh embodiment, the movable portion is supported in the radial direction at two locations such as the needle tip portion and the sliding member 72. In contrast, the movable portion M may be supported from the radial direction at two locations such as the outer circumferential surface of the movable core 30 and the needle tip portion.

In the first embodiment, the inner core 32 is made of a non-magnetic material, but may be made of a magnetic material. When the inner core 32 is made of a magnetic material, the inner core 32 may be made of a weak magnetic material having a weaker magnetism than that of the outer core 31. Similarly, the needle 20 and the guide member 60 may be made of a weak magnetic material having a weaker magnetism than that of the outer core 31.

In the first embodiment, the cup 50 is interposed between the movable core 30 and the first spring member SP1 in order to achieve a core boost structure in which the movable core 30 is brought into contact with the needle 20 to start a valve opening operation at the time at which the movable core 30 is moved by a predetermined amount. In contrast, a core boost structure may be used in which the cup 50 is omitted, a third spring member different from the first spring member SP1 is provided, and the movable core 30 is biased toward the injection hole side by the third spring member.

As described above, the region surrounded by the straight line L10 connecting the portions closest to the axis C1 of the circumferential edges of the respective inflow ports 11in is defined as the virtual region. As illustrated in FIG. 6, this virtual region may have a point-symmetrical and regular polygon with the axis C1 as the center of symmetry, or may have a non-point-symmetrical shape.

In each of the above embodiments, among the tapered surface 111, the body bottom surface 112, and the connecting surface 113 forming the fuel passage 11*b*, the injection hole 11*a* is provided in the body bottom surface 112. In contrast, the injection hole 11*a* may be provided in a portion of the tapered surface 111 on the downstream side of the seating surface 11*s* or the connecting surface 113.

In each of the above embodiments, the needle 20 is configured to be movable relative to the movable core 30, but the movable core 30 and the needle 20 may be integrally configured not to be relatively movable. The movable core 30 is required to return to an initial position when the second and subsequent injection operations related to the split injection are performed. However, when the movable core 30 and the needle 20 are integrally configured as described above, the needle 20 is heavy to be easily subjected to valve closing bounce. Thus, the effect of reducing bounce by setting the seat angle θ to 90 degrees or less is suitably achieved in a case of the above-described integrated configuration.

Figure 23:
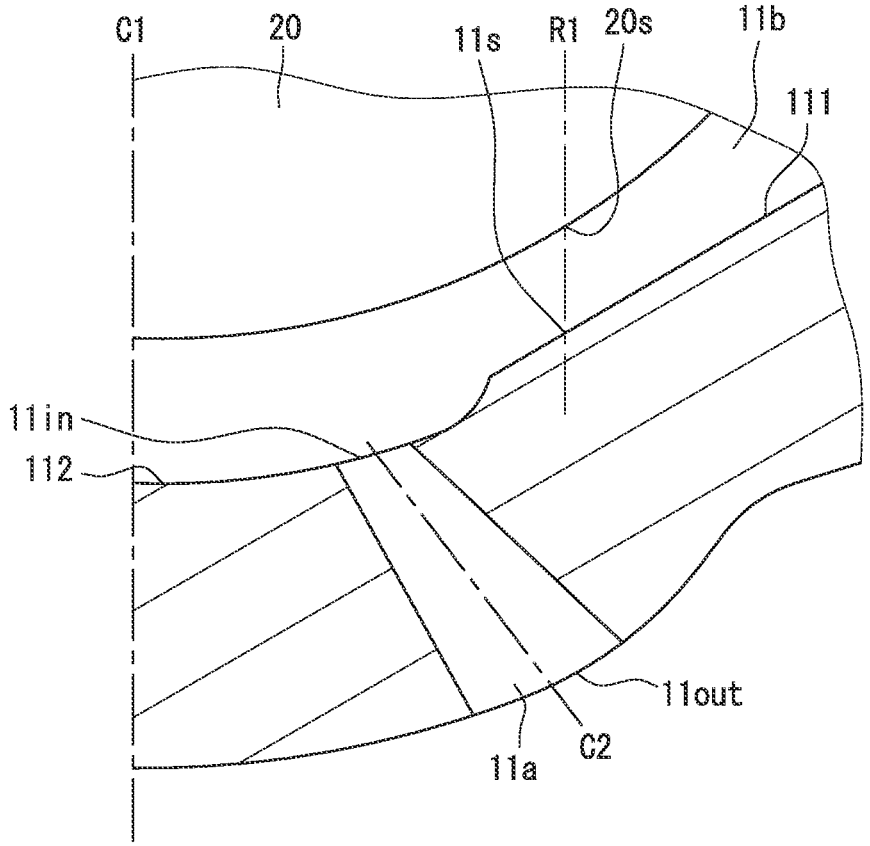
FIG. 23 is a sectional view of an injection hole illustrating a modified example of the fourth embodiment.

A shape of the injection hole 11*a* according to the fourth embodiment is a tapered shape of a diameter gradually decreases from the inflow port 11in to the outflow port 11out (refer to FIG. 18). In contrast, as illustrated in FIG. 23, the injection hole 11*a* may have a reverse tapered shape opposite to the shape in FIG. 18. That is, the shape of the injection hole 11*a* in the cross section including the axis C2 is a tapered shape of which a diameter gradually increases from the inflow port 11in to the outflow port 11out, and an opening area of the inflow port 11in is smaller than an opening area of the outflow port 11out. In the example illustrated in FIG. 23, a passage sectional area of the inflow port 11in or a portion in the vicinity thereof corresponds to the injection hole passage sectional area S1 that contributes to the injection hole throttle.

What is claimed is:

1. A fuel injection valve comprising:

an injection hole body having an injection hole configured to inject fuel;

a valve body having a seat surface configured to be separated from and seated on a seating surface of the injection hole body; and a fuel passage between the injection hole body and the valve body, the fuel passage configured to communicate with an inflow port of the injection hole and configured to be opened and closed due to separation and seating of the valve body, wherein the seat surface is curved and is swollen toward the seating surface, in a seat portion throttle state, a flow rate of the fuel injected from the injection hole is restricted to a flow rate throttled by a gap between the seat surface and the seating surface, in an injection hole throttle state, the flow rate of the fuel is restricted to a flow rate throttled by the injection hole, when the valve body is operated to be opened from a valve closing position to a full lift position, the seat portion throttle state is brought from the valve closing position to a predetermined intermediate position, and the injection hole throttle state is brought from the intermediate position to the full lift position, a passage sectional area of an inter-seat-injection-hole gap that is a portion of the fuel passage on the downstream side of the seating surface is an inter-seat-injection-hole passage sectional area, a passage sectional area of the injection hole is an injection hole passage sectional area, and in a valve closed state in which the valve body is seated on the injection hole body, the inter-seat-injection-hole passage sectional area is smaller than the injection hole passage sectional area.

2. The fuel injection valve according to claim 1, wherein the injection hole body includes a tapered surface that has the seating surface and is formed in a linear shape in a cross section including a central axis of the valve body, and a body bottom surface that defines the inflow port and is formed in a shape recessed from the tapered surface.

3. The fuel injection valve according to claim 1, wherein the valve body has a tip portion located downstream of the seat surface, and the tip portion defines a flat surface extending perpendicularly to a central axis of the valve body.

4. The fuel injection valve according to claim 1, wherein a valve body tip surface of the valve body is an entire outer surface portion on a downstream side of the seat surface relative to a fuel flow, a distance between the valve body tip surface and the injection hole body in a direction of a central axis of the valve body is a valve body separation distance, a circle centered on a central axis passing through a center of the inflow port is an inflow center virtual circle, and the valve body separation distance is continuously reduced in a radial direction from a circumferential edge of the inflow center virtual circle along a direction toward the central axis.

5. A fuel injection valve comprising:

an injection hole body having an injection hole configured to inject fuel for combustion of an internal combustion engine;

a valve body having a seat surface configured to be separated from and seated on a seating surface of the injection hole body; and a fuel passage between the injection hole body and the valve body, the fuel passage configured to communicate with an inflow port of the injection hole and configured to be opened and closed due to separation and seating of the valve body, wherein the seat surface is curved and is swollen toward the seating surface, and in a seat portion throttle state, a flow rate of the fuel injected from the injection hole is restricted to a flow rate throttled by a gap between the seat surface and the seating surface, in an inter-seat-injection-hole throttle state, the fuel is restricted to a flow rate throttled by an inter-seat-injection-hole gap that is a portion of the fuel passage on a downstream side of the seating surface, and when the valve body is operated to be opened from a valve closing position to a full lift position, the seat portion throttle state is brought from the valve closing position to a predetermined intermediate position, and the inter-seat-injection-hole throttle state is brought from the intermediate position to the full lift position.

6. The fuel injection valve according to claim 5, wherein a passage sectional area of an inter-seat-injection-hole gap that is the portion of the fuel passage on the downstream side of the seating surface is an inter-seat-injection-hole passage sectional area, a passage sectional area of the injection hole is an injection hole passage sectional area, and in a valve closed state in which the valve body is seated on the injection hole body, the inter-seat-injection-hole passage sectional area is smaller than the injection hole passage sectional area.

* * * * *